US006336280B1

(12) United States Patent
Haigh

(10) Patent No.: US 6,336,280 B1
(45) Date of Patent: Jan. 8, 2002

(54) SELF-PROPELLED ROTARY EXCAVATOR

(75) Inventor: Norman M. Haigh, Natchez, MS (US)

(73) Assignee: Mississippi State University, Mississippi State, MS (US)

( * ) Notice: Subject to any disclaimer, the term of this patent is extended or adjusted under 35 U.S.C. 154(b) by 0 days.

(21) Appl. No.: 09/605,896

(22) Filed: Jun. 29, 2000

(51) Int. Cl.[7] ..... E01F 5/08
(52) U.S. Cl. ..... 37/92; 37/365; 37/352
(58) Field of Search ..... 37/91, 92, 93, 37/105, 302, 365, 352; 212/231; 414/451, 688, 718; 52/116, 117, 118, 119

(56) References Cited

U.S. PATENT DOCUMENTS

| | | | | |
|---|---|---|---|---|
| 1,162,607 | A | * | 11/1915 | Hoar |
| 1,321,983 | A | * | 11/1919 | Cole |
| 2,899,088 | A | * | 8/1959 | Corbin |
| 2,942,360 | A | | 6/1960 | Hawkins et al. |
| 2,956,691 | A | * | 10/1960 | Fangman |
| 3,132,430 | A | | 5/1964 | Barras |
| 3,645,020 | A | | 2/1972 | Beslin et al. |
| 3,683,522 | A | | 8/1972 | Rousseau et al. |
| 3,727,332 | A | | 4/1973 | Zimmer |
| 4,106,225 | A | * | 8/1978 | Schnabel et al. |
| 4,459,767 | A | | 7/1984 | Cartner |
| 4,506,464 | A | | 3/1985 | Cartner |
| 4,542,940 | A | * | 9/1985 | Marten |
| 4,607,716 | A | * | 8/1986 | Beck |
| 4,612,715 | A | | 9/1986 | Cartner |
| 4,712,320 | A | | 12/1987 | Cartner |
| 4,939,854 | A | * | 7/1990 | Boren |
| 4,945,221 | A | * | 7/1990 | Nielsen et al. |
| 5,101,583 | A | * | 4/1992 | Scordilis |
| 5,511,326 | A | | 4/1996 | Liebrecht, Jr. |
| 5,848,485 | A | * | 12/1998 | Anderson et al. |

FOREIGN PATENT DOCUMENTS

| | | | |
|---|---|---|---|
| FR | 789 766 | | 8/1934 |
| FR | 2 420 607 | | 10/1979 |
| JP | 8-92994 | * | 9/1994 |
| SU | 641036 | | 12/1975 |

* cited by examiner

*Primary Examiner*—H. Shackelford
(74) *Attorney, Agent, or Firm*—Piper Marbury Rudnick & Wolfe LLP; Steven B. Kelber

(57) ABSTRACT

A self-propelled rotary excavator having a plurality of booms forming a boom assembly attached to a chassis, with a rotary cutting device attached to the end of the boom assembly. The boom assembly positions the rotary cutting device at a desired position in regard to the chassis or moving portion of the self-propelled rotary excavator. The position of the rotary cutting device is maintainable (preferably controlled by lasers) so as to provide a ditch which has a constant grade regardless of the undulations of the land upon which the self-propelled rotary excavator traverses. An operator of the self-propelled rotary excavator can also independently control both the depth of the cut produced by the rotary cutting device and the distance in a direction perpendicular to the depth of the cut produced by the rotary cutting device. Such independent control of the boom assembly allows the operator of the self-propelled rotary excavator to provide a ditch which is capable of avoiding large objects which may damage the rotary cutting device or the operator may produce a special cut in the ditch such as a localized deep portion so as to act as a silt accumulator. Thus, the self-propelled rotary excavator provides a cutting device which is capable of cutting deeply into the soil to provide a deep drainage ditch, while operating over rough terrain.

17 Claims, 42 Drawing Sheets

SELF-PROPELLED ROTARY EXCAVATOR

BACKGROUND OF THE INVENTION

1. Field of the Invention

The invention relates generally to excavators and more particularly to a self-propelled rotary excavating machine that cuts new drainage ditches and maintains existing drainage ditches with laser precision.

2. Discussion of the Background

Alluvial soils located on flood plains of streams need to be drained before they can be developed, for example, for agricultural uses.

The parcels of land to be drained are fitted into a general drainage plan for the entire acreage. Typically, the excavation of a drainage ditch was accomplished with draglines and dozers. The draglines were, typically, of various sizes, depending on the required excavation and the distance necessary to reach the excavation area. A further factor to consider was to place the excavated soil, known as spoil, in the vicinity of road or levee construction. Large drainage ditches required the use of a large dragline having a long boom. Smaller field and lateral ditches which feed into the larger drainage ditches were excavated by smaller draglines.

The use of the draglines either to form the drainage ditch or to dredge a preexisting drainage ditch requires the additional use of dozers to move and shape the resulting spoil into roads or levees or to spread it out in the adjoining fields as drainage ditches were being excavated.

During the early 1970's, trackhoes became available to cut drainage ditches. Trackhoes are more efficient for excavating small ditches than are draglines. At that time, trackhoes were used for field drainage and other development that did not require the use of a large capacity machine. Trackhoes and draglines equipped with wide tracks can operate under very wet field conditions. However, a problem with using trackhoes and draglines in wet conditions is that leveling wet spoil will result in future crop losses in the affected area.

Also used to cut drainage ditches were rotary power ditchers. A rotary power ditcher is a device mounted on a tractor's 3-point hitch driven by the power take-off shaft. The use of this device was usually for making a network of small water furrows cut in small natural drains and through field depressions connecting to the field ditches. In some instances, the small water furrows would extend up to a quarter of a mile in length. Attempting to move water run-off up to a quarter mile on nearly level or flat land via a small water furrow usually created several problems. Such problems occur during heavy rainfall when large volumes of water accumulate and flow across the field, thus, scouring the field in some areas. Water moving across a freshly cultivated field under these conditions will move silt into the field ditches. Some of the furrows will then be closed by silt, thus, resulting in water ponding in field depressions. The soil surrounding the ponded area then becomes saturated with water. The silt also forms silt bars in field ditches which reduce their drainage efficiency.

Drainage ditches which are filled with silt must be re-excavated so as to maintain efficient drainage of the field. Thus, there is a maintenance schedule for the regular clearing of the silt-filled drainage ditches. The annual ongoing and recurring high cost of ditch maintenance performed by slow moving hydraulic trackhoes and dozers was unacceptable.

Hydraulic trackhoes are more efficient than draglines in excavating and maintaining field and lateral ditches.

However, the efficiency of hydraulic trackhoes is not comparable to the speed and efficiency of smaller tractor mounted rotary powered ditchers. The small tractor mounted rotary powered ditchers are suitable for cutting small water furrows to carry water run-off from field depressions to field drainage ditches.

Thus, there is a need for an efficient device for excavating water furrows which cuts a water furrow such that it does not fill-up with silt as quickly as do water furrows cut by preexisting devices.

SUMMARY OF THE INVENTION

The invention meets the aforementioned need to a great extent by providing a self-propelled rotary excavator that excavates a field drainage ditch in such a manner that it can be done swiftly, efficiently, economically, and which can reduce the need for periodic maintenance of the drainage ditch.

In one embodiment of the invention, the self-propelled rotary excavator includes a mobile platform, a lateral telescoping boom attached on one end to the mobile platform, and on the other end to a vertical telescoping boom to which is attached a rotary cutting device that includes an adjustable shield for directing the discharge of spoil.

In still another aspect of the invention, the self-propelled rotary excavator includes a laser control system to control the horizontal and vertical positions of the rotary cutter.

In another preferred embodiment of the invention, the self-propelled rotary excavator includes a vehicular chassis mounted on four wheels, each wheel having its own independent source of power.

The present invention provides a precision self-propelled rotary excavator with a cutting device capable of cutting deeply into the soil to make a deep drainage ditch in a rough terrain environment. The prior art does not disclose the use of a self-propelled rotary excavator that can operate over rough terrain with precise lateral and vertical rotor positioning while evenly distributing the spoil on the field. Furthermore, the self-propelled rotary excavator is able to operate where draglines and trackhoes cannot, and furthermore it can operate the larger, heavy rotary cutting device which is not possible with a tractor.

Another aspect of the invention is that it will evenly distribute wet spoil such that crop losses are avoided.

Still another aspect of the invention is the provision of the ability to clean and maintain an existing ditch without having to straddle the ditch.

BRIEF DESCRIPTION OF THE DRAWINGS

A more complete appreciation of the invention and many of the attendant advantages thereof will be readily obtained as the same becomes better understood by reference to the following detailed description and accompanying drawings, wherein.

DETAILED DESCRIPTION OF THE PREFERRED EMBODIMENTS

Figure 1:
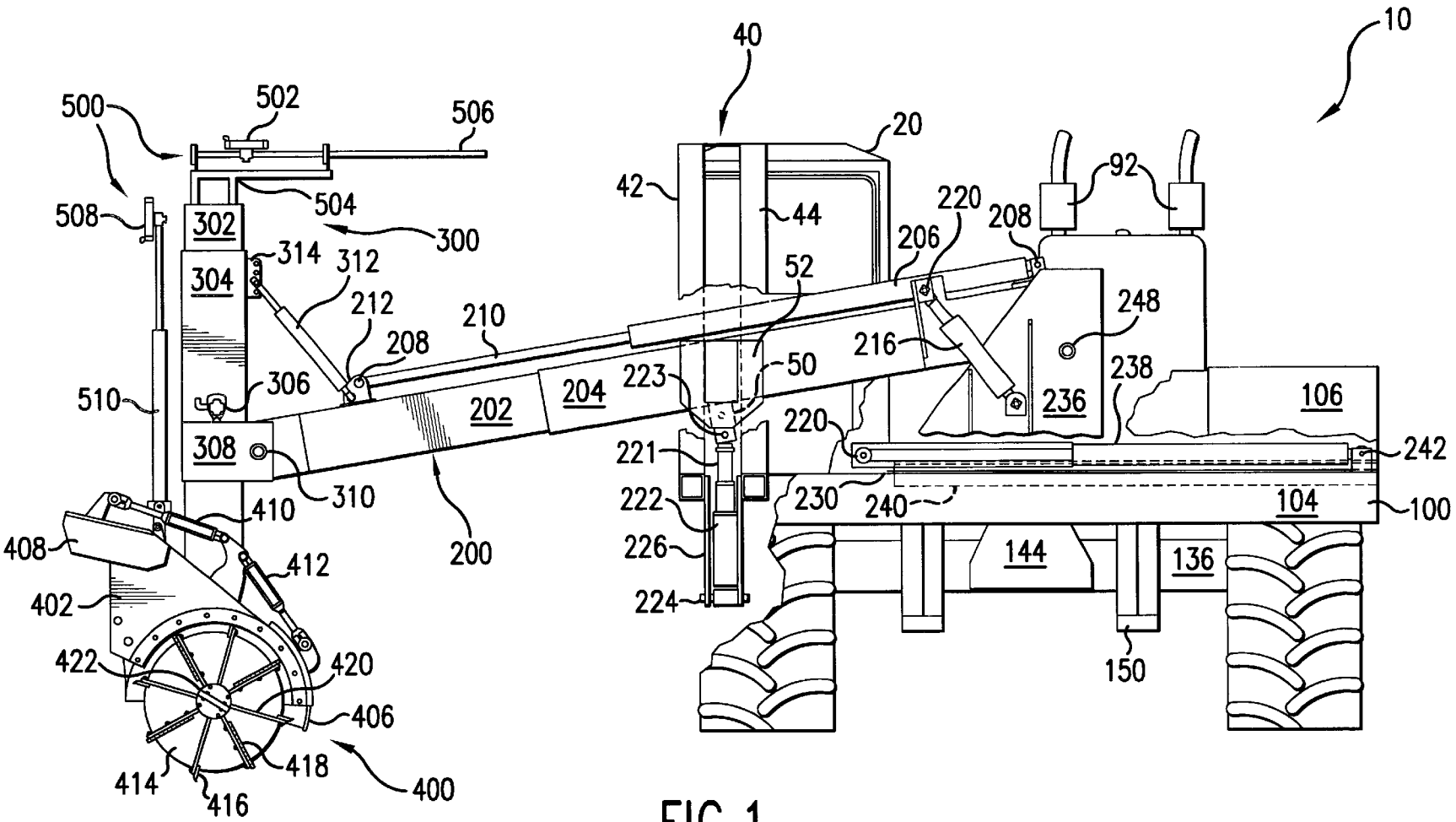
FIG. 1 is a front view of an excavator according to a preferred embodiment of the invention.

Referring now to the figures, wherein like reference numerals designate identical or corresponding parts throughout the several views, FIG. 1 is a front view of one embodiment of a self-propelled rotary excavator according to the present invention. Attached to the frame 100 is a left front fender 106, and a right front fender (not shown in FIG. 1). Also attached to the frame 100 is a water reservoir tank (not shown in FIG. 1), a hydraulic fluid reservoir (not shown in FIG. 1), a front vehicle frame beam 104, a cab 20, a boom guide 40, and a lateral telescopic boom assembly 200. Attached to the distal end of the lateral telescopic boom assembly 200 is the vertical boom assembly 300. Attached to the top end of the vertical boom assembly 300 is a laser assembly 500 including a laser alignment control receiver 502 and a vertical sensing depth control laser receiver 508. Further shown in FIG. 1 is the right front lateral boom vertical guide 42 and the left front lateral boom vertical guide 44 of the boom guide 40.

The lateral telescopic boom assembly 200 includes a pair of lateral boom positioning hydraulic cylinders 216 and 218 (216 shown in FIG. 1) attached to the lateral boom base mounting assembly 236 and another end of the lateral boom hydraulic cylinder 216 is connected to the lateral telescopic stationary boom 204 to a mount 220. A lateral telescopic extendable boom 202 is movably attached within the lateral telescopic stationary boom 204. A lateral telescopic extendable boom hydraulic cylinder 206 is attached to the lateral telescopic stationary boom 204 at mount 208. A lateral telescopic extendable boom hydraulic cylinder ram 210 is movably attached to the lateral telescopic extendable boom hydraulic cylinder 206. The other end of the lateral telescopic extendable boom hydraulic cylinder ram 210 is attached to the lateral telescopic extendable boom 202.

Pivotally attached at mount 310 to the lateral telescopic extendable boom 202 is a vertical telescopic stationary boom 304. Movably mounted within the vertical telescopic stationary boom 304 is a vertical telescopic extendable boom 302. A vertical telescopic boom position control cylinder 312 is pivotally attached at one end to the lateral telescopic extendable boom 202 (at mount 212) and at the other end to the vertical telescopic stationary boom 304 (at mount 314) so as to pivot the vertical boom assembly 300 relative to the lateral telescopic boom assembly 200.

Attached to one end of the vertical telescopic extendable boom 302 of the vertical boom assembly 300 is the rotary cutting head assembly 400. The rotary cutting head assembly 400 includes a rotary cutting head shield 402 and a rotary cutting head rotor 414. Attached to atop end of the vertical telescopic extendable boom 302 is a laser alignment control receiver 502. Also connected to the vertical telescopic extendable boom 302 is the vertical sensing depth control laser receiver 508.

Figure 2:
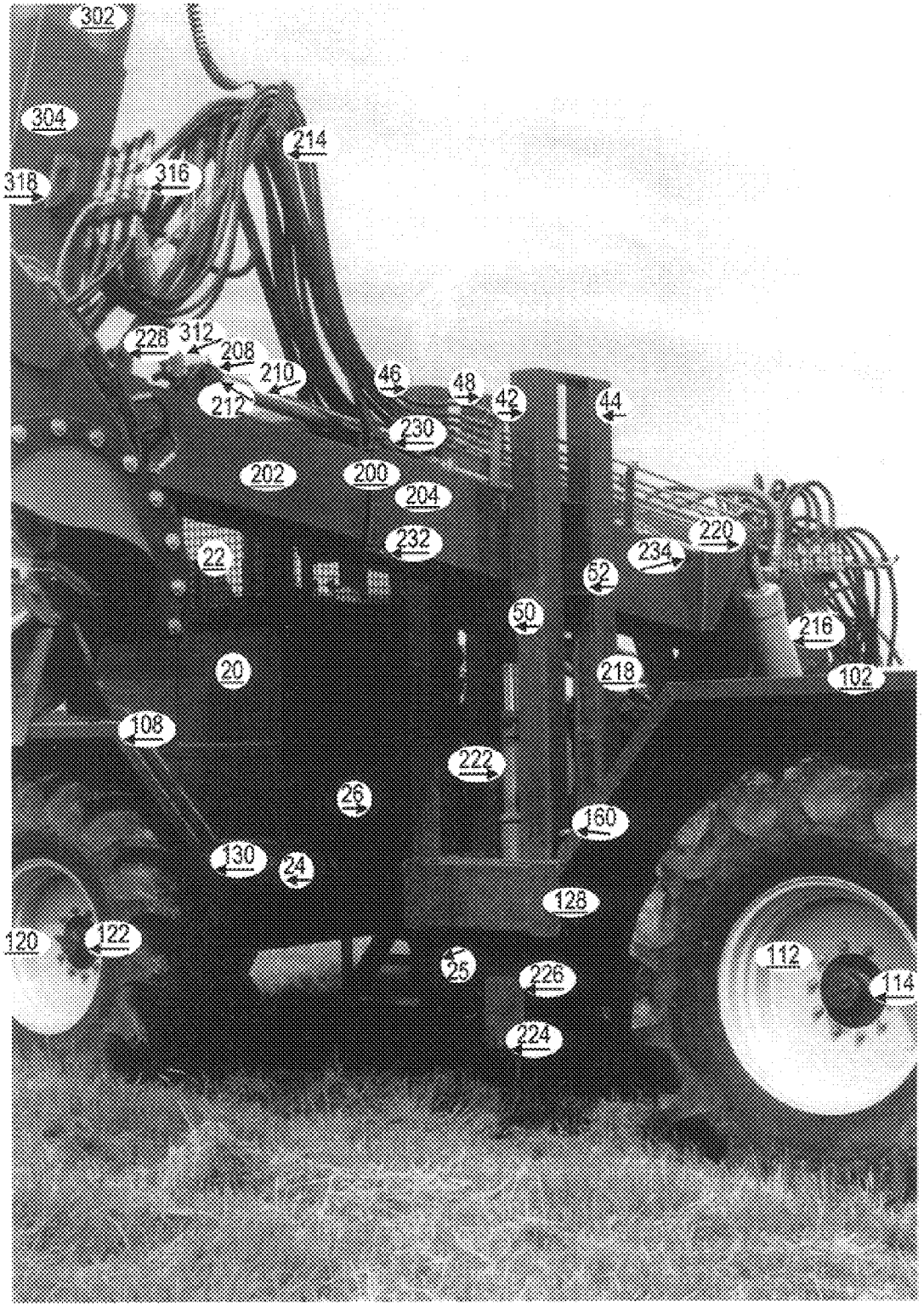
FIG. 2 is a partial perspective view of the excavator of FIG. 1.

FIG. 2 is a partial perspective view of the invention as shown in FIG. 1. FIG. 2 displays the right front fender 102 and the right rear fender 108 attached to the frame 100 (FIG. 1). Also connected to the frame 100 is the right front wheel hub 114 and the right rear wheel hub 122. A right front wheel 112 is attached to the right front wheel hub 114 and a right rear wheel 120 is attached to the right rear wheel hub 122. Further shown in FIG. 2 is a rear-central frame section 130 attached to the frame 100 and the cab 20 attached to the frame 100. The cab 20 includes a cab screen protector 22. Further attached to the frame 100 is a safety hand rail 26, grated steps 25 and a frontal cab supporting base 24. The frame 100 further includes a front-central frame section 128.

Also shown in FIG. 2 is the right front lateral boom vertical guide 42, the left front lateral boom vertical guide 44, the right rear lateral boom vertical guide 46, and the left rear lateral boom vertical guide 48 of the boom guide 40 (FIG. 1) attached to the frame 100. Attached to the lateral telescopic stationary boom 204 is a lateral boom rest vertical guide 52 and a lateral boom rest 50. The lateral boom rest vertical guide 52 is also slidably mounted in the boom guide 40 between the right front lateral boom vertical guide 42 and the left front lateral boom vertical guide 44. A portion of the lateral boom rest vertical guide 52 is also slidably mounted between the right rear lateral boom vertical guide 46 and the left rear lateral boom vertical guide 48.

One end of each of the forward twin lateral boom hydraulic cylinder 216 and the rear twin lateral boom hydraulic cylinder 218 are rotatably mounted to the lateral boom base mounting assembly 236. The other end of each of the cylinders 216, 218 are rotatably connected to lateral boom hydraulic cylinder ram pins. Cylinder 216 is shown connected to the forward ram pin 220. Cylinders 216 and 218 are connected to each side of the lateral telescopic stationary boom 204 of the lateral telescopic boom assembly 200.

Figure 27:
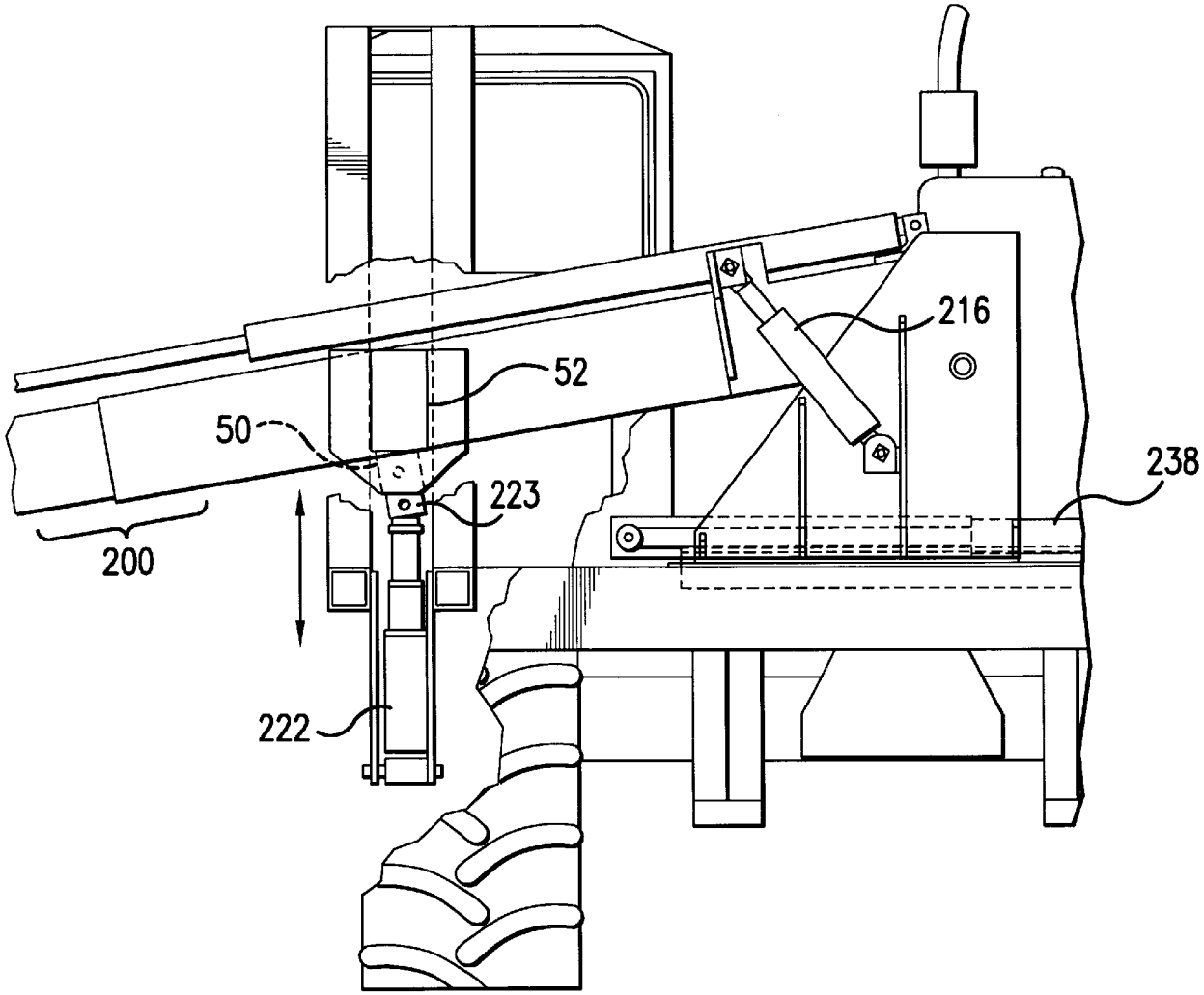
FIG. 27 is a partial front view of the excavator of FIG. 1.

Referring now to FIG. 27, the elevation of the lateral boom assembly 200 is controlled by a four-stage hydraulic cylinder 222. The forward and rear twin boom hydraulic cylinders 216, 218, are disengaged during operation of the machine 10. This allows the lateral telescopic boom assembly 200 free upward movement in the event an obstacle is encountered during excavation. The main purpose of the twin lateral boom hydraulic cylinders 216, 218 is to elevate the lateral telescopic boom assembly 200 when the lateral boom deck extension hydraulic cylinder 238 is being used to reposition the lateral boom base mounting assembly 236 as described in further detail in connection with FIG. 7.

Referring now back to FIG. 2, the lateral telescopic extendable boom 202 is slidably mounted within the lateral telescopic stationary boom 204. A lateral telescopic stationary boom roller 232 is rotatably mounted near an end of the lateral telescopic stationary boom 204. The lateral telescopic extendable boom 202 is in rolling contact with the lateral telescopic stationary boom roller 232.

The lateral telescopic extendable boom hydraulic cylinder ram 210 of the lateral telescopic extendable boom hydraulic cylinder 206 is rotatably connected to the lateral telescopic extendable boom hydraulic cylinder ram pin 208. The lateral telescopic extendable boom hydraulic cylinder ram pin 208 is attached to a lateral telescopic extendable boom hydraulic cylinder ram pin mounting bracket 212. In tun, the lateral telescopic extendable boom hydraulic cylinder ram pin mounting bracket 212 is connected to the lateral telescopic extendable boom 202.

Figure 28A:
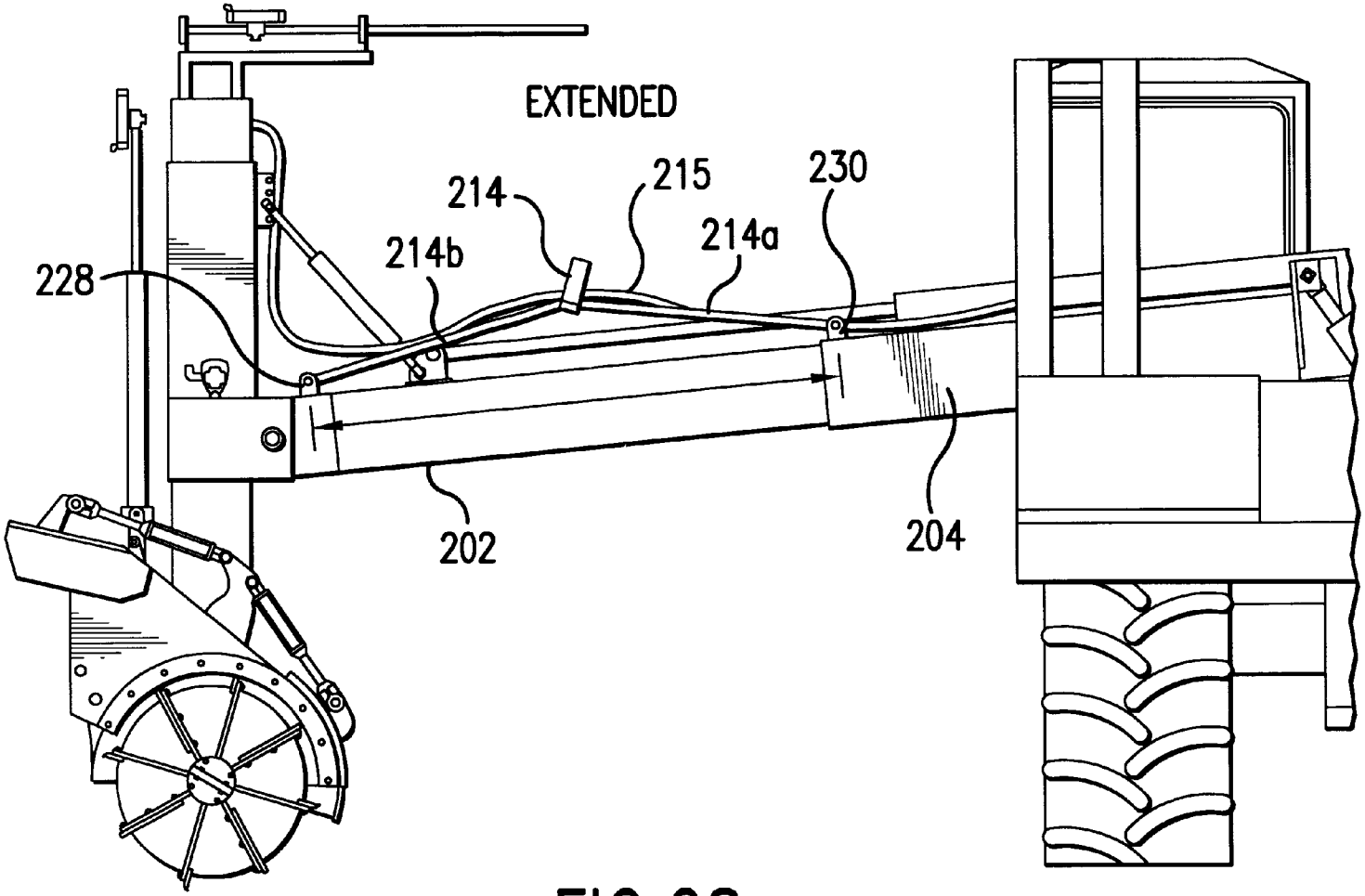
FIGS. 28*a–c* are partial front views of the excavator of FIG. 1 showing the rotary cutting head assembly and hydraulic hose support in different positions.
Figure 28B:
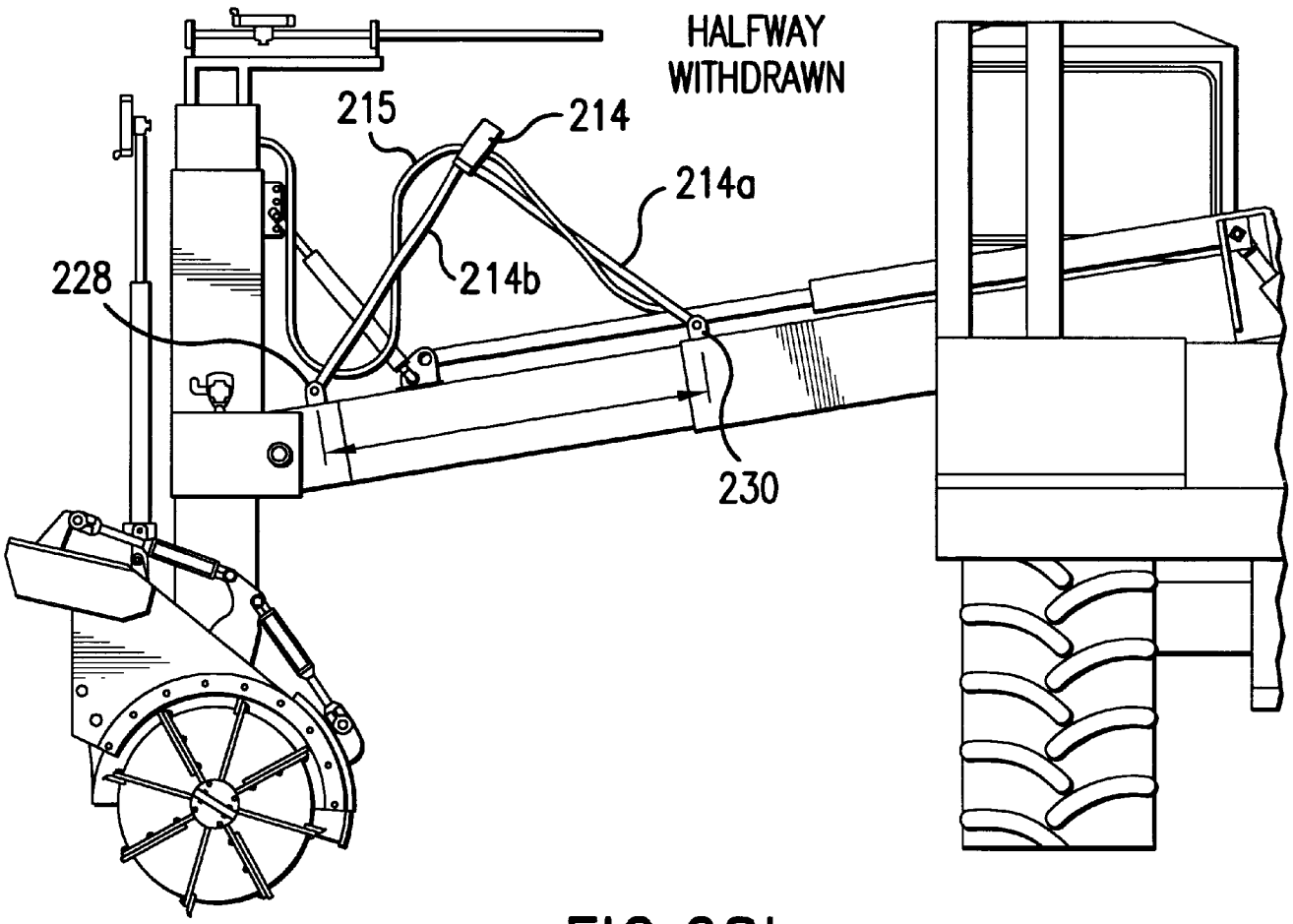
Figure 28C:
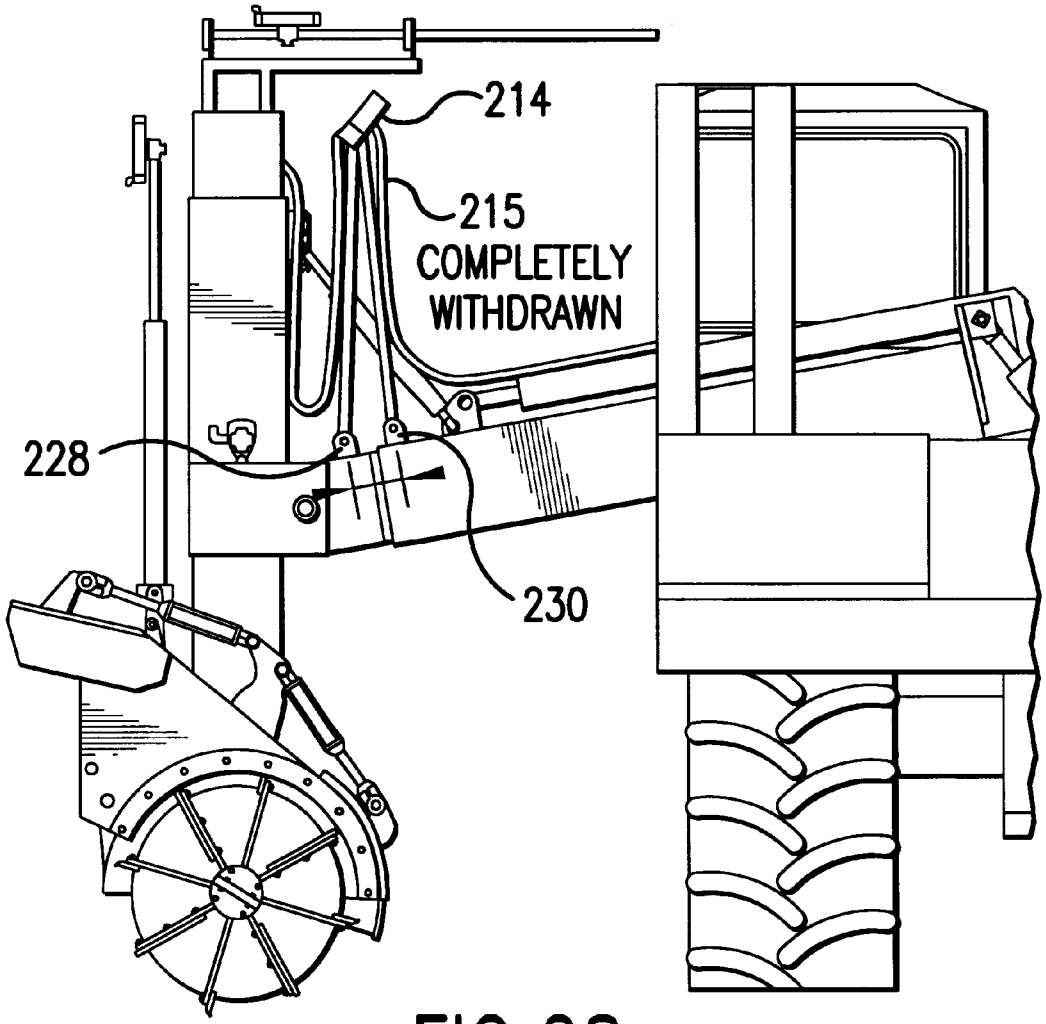

A hydraulic hose support 214, which is depicted further in FIGS. 28*a–c*, is provided to keep hydraulic hoses 215 from being damaged during movement of the lateral telescopic extendable boom 202. The hose support 214 includes two legs 214*a*, 214*b*. The proximal ends of the legs are pivotally connected. The distal end of leg 214*a* is rotatably mounted on mounting bracket 230 on the lateral telescopic stationary boom 204. The distal end of leg 214*b* is rotatably mounted on mounting bracket 228 on the lateral telescopic extendable boom 202. As shown in FIGS. 28*a–c*, this arrangement allows the hose support 214 to extend and retract along with the lateral telescopic boom 202 while keeping the hoses 215 safe. Further shown in FIG. 2 are the quick release hydraulic hose connectors 316.

Attached to an end of the lateral telescopic extendable boom 202 is the vertical telescopic stationary boom 304. The vertical telescopic extendable boom 302 (shown in FIG. 3) is slidably mounted in the vertical telescopic stationary boom 304. A vertical boom lifting bracket 318 is provided on the vertical telescopic stationary boom 304.

Figure 3:
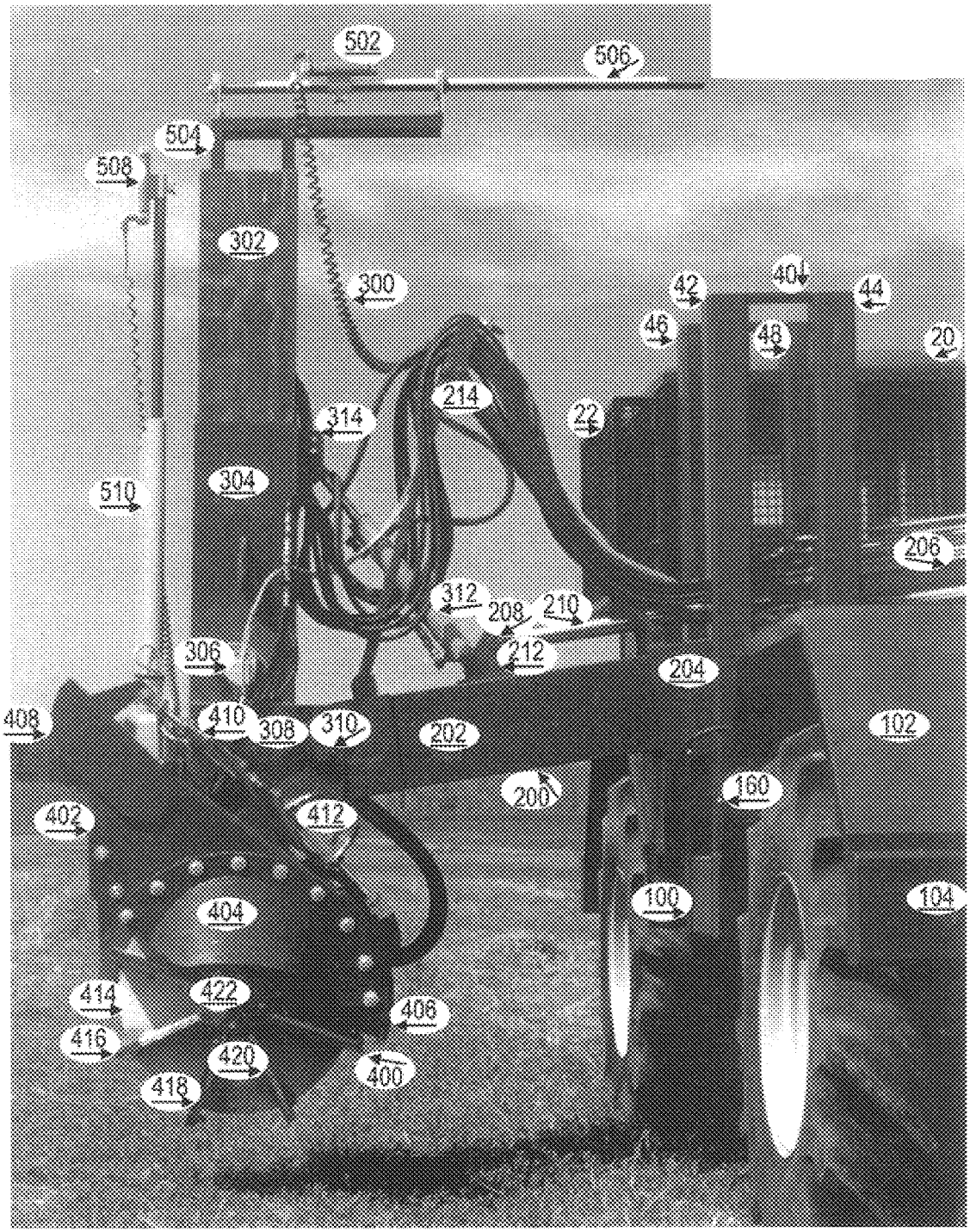
FIG. 3 is a partial front view of the excavator of FIG. 1 showing the lateral and vertical booms and the rotary cutting head rotor.

FIG. 3 is a partial front view of the invention showing the lateral telescopic boom assembly 200, the vertical boom assembly 300 and the rotary cutting head assembly 400. FIG. 3 further shows the right front fender 102 attached to the frame 100 and the front vehicle frame beam 104 of the frame 100. Also shown is the right high pressure water coupling receptacle 160. The cab 20 is shown along with the cab screen protector 22. The right and left front lateral boom vertical guides 42, 44 and the right and left rear lateral boom vertical guides 46, 48 of the boom guide 40, which attach to the frame 100, are also shown.

FIG. 3 further shows a pivot pin mounting bracket 314 attached to the vertical telescopic stationary boom 304. One end of the vertical telescopic boom position control cylinder 312 is rotatably connected to the mounting bracket 314. The other end of the vertical telescopic boom position control cylinder 312 is connected to the mounting bracket 212 on the lateral telescopic extendable boom 202. The vertical telescopic boom position control cylinder 312 controls the angular position of the vertical telescopic stationary boom 304 relative to the lateral telescopic extendable boom 202.

Figure 31:
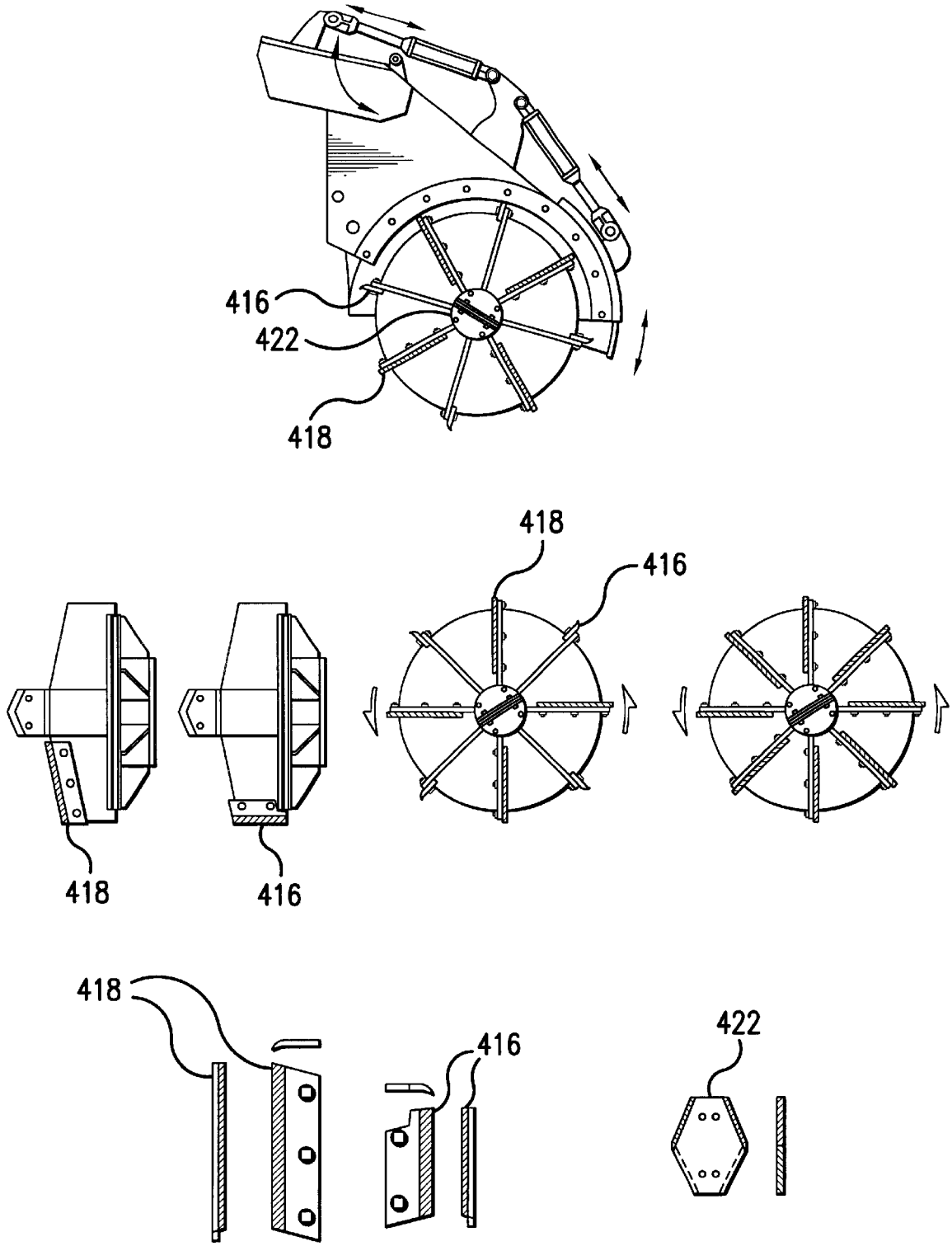
FIG. 31 shows a partially exposed rotary cutting head assembly and various views of the rotary cutting head in a clockwise configuration.
Figure 32:
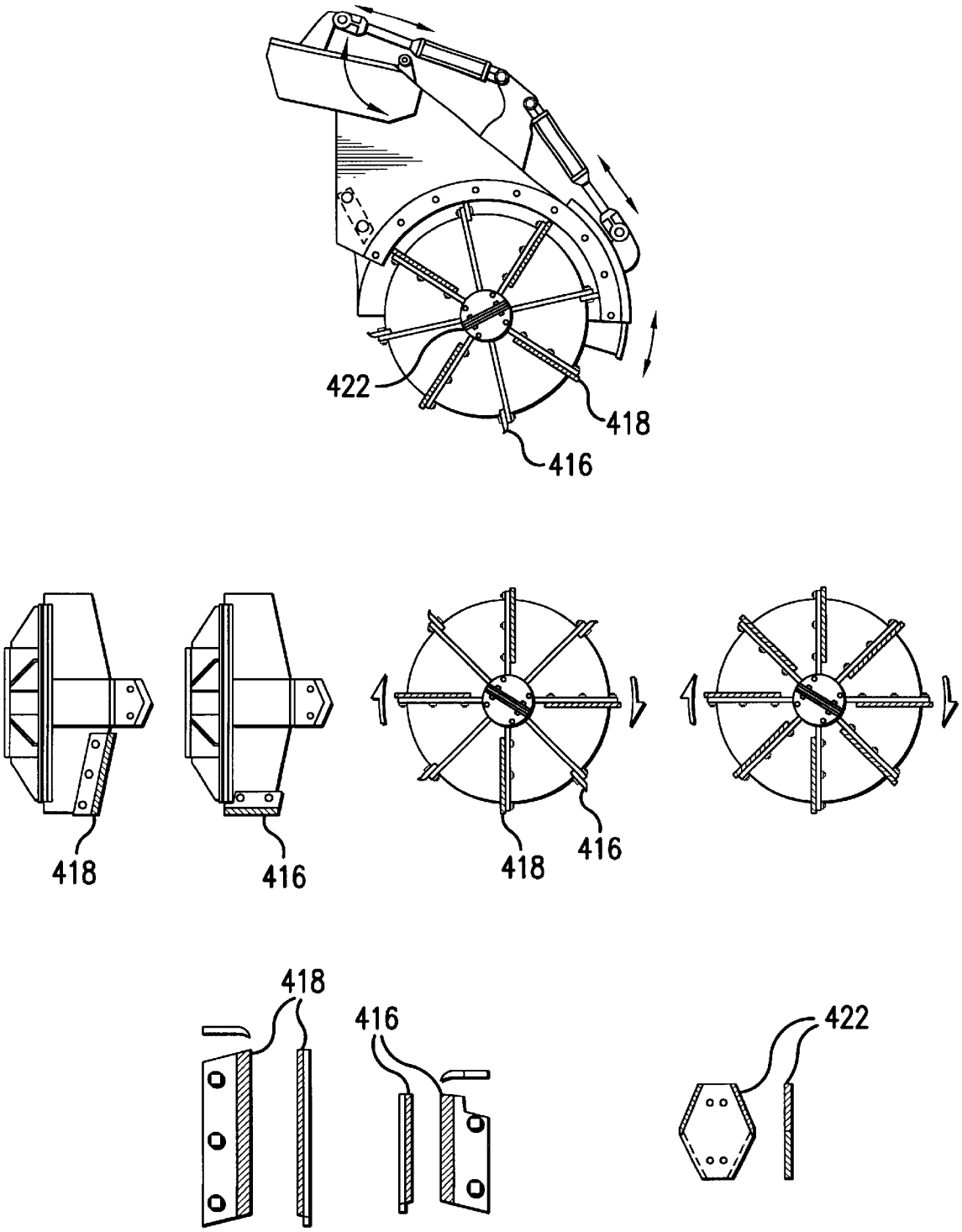
FIG. 32 shows a partially exposed rotary cutting head assembly and various views of the rotary cutting head in a counter-clockwise configuration.

The rotary cutting head assembly 400 is shown connected to the vertical telescopic extendable boom 302. The rotary cutting head assembly 400 includes a rotor 414. Attached to the rotor 414 are eight rotary cutting head blade mounting brackets 420. Attached to the rotary cutting head blade mounting brackets 420 are rotor blades 418 and rotor impeller blades 416. As shown in FIGS. 31 and 32, the brackets may be equipped with blades 416, 418 arranged for either clockwise or counter-clockwise rotation, and the blades 416, 418 may be arranged in various configurations. In the center of the rotor 414 is attached a rotary cutting head central reversible blade 422.

Figure 30:
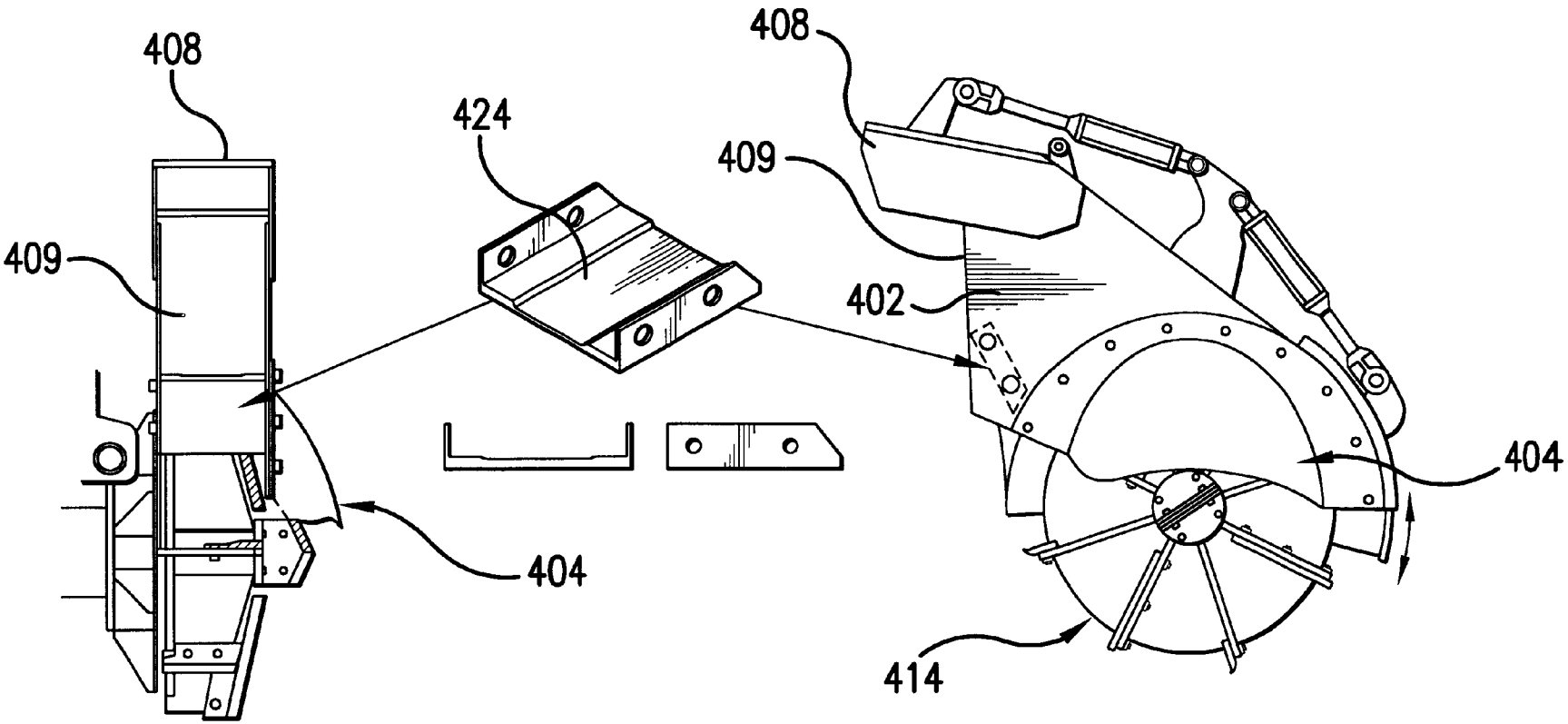
FIG. 30 shows front and side view of the rotary cutting head assembly.

Surrounding a part of the rotor 414 are a rotary cutting head shield 402 and a rotary cutting head frontal extension shield 404. The extension shield 404 is attached to the head shield 402, which are also shown in FIG. 30. The rotary cutting head shield 402 partially encloses the rotor 414. In operation, the rotary cutting head shield 402 contains the spoil material as it is excavated from the soil surface and set in motion. The rotary cutting head shield 402 then directs the trajectory of the spoil to a controlled point of departure through a shield outlet 409. A deflector shield 424 should be installed within the shield outlet 409 when the rotor 414 is moving in a counter-clockwise direction. The deflector shield 424 prevents the spoil material from recycling around the rotor 414 and accumulating in the shield 402 by deflecting material away from the rotor 414.

The rotary cutting head frontal extension shield 404 is a forward extension of the rotary cutting head shield 402. The frontal extension shield 404 prevents excavated material from moving forward and directs it back toward the rotor 414 so it will be expelled through shield outlet 409.

Figure 29A:
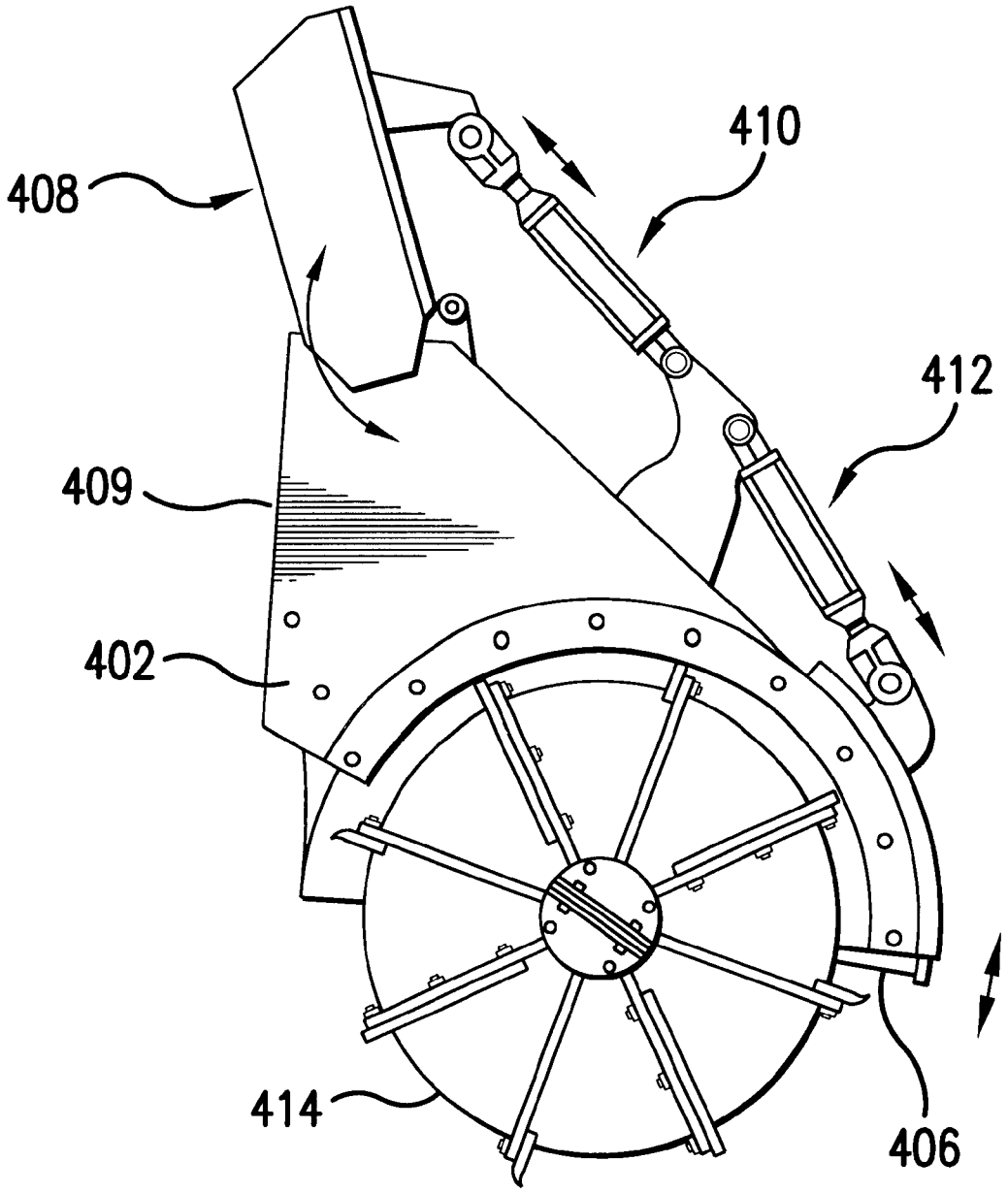
FIGS. 29*a–b* are front views of the rotary cutting head assembly with an adjustable extension shield and an adjustable deflection shield in various positions.
Figure 29B:
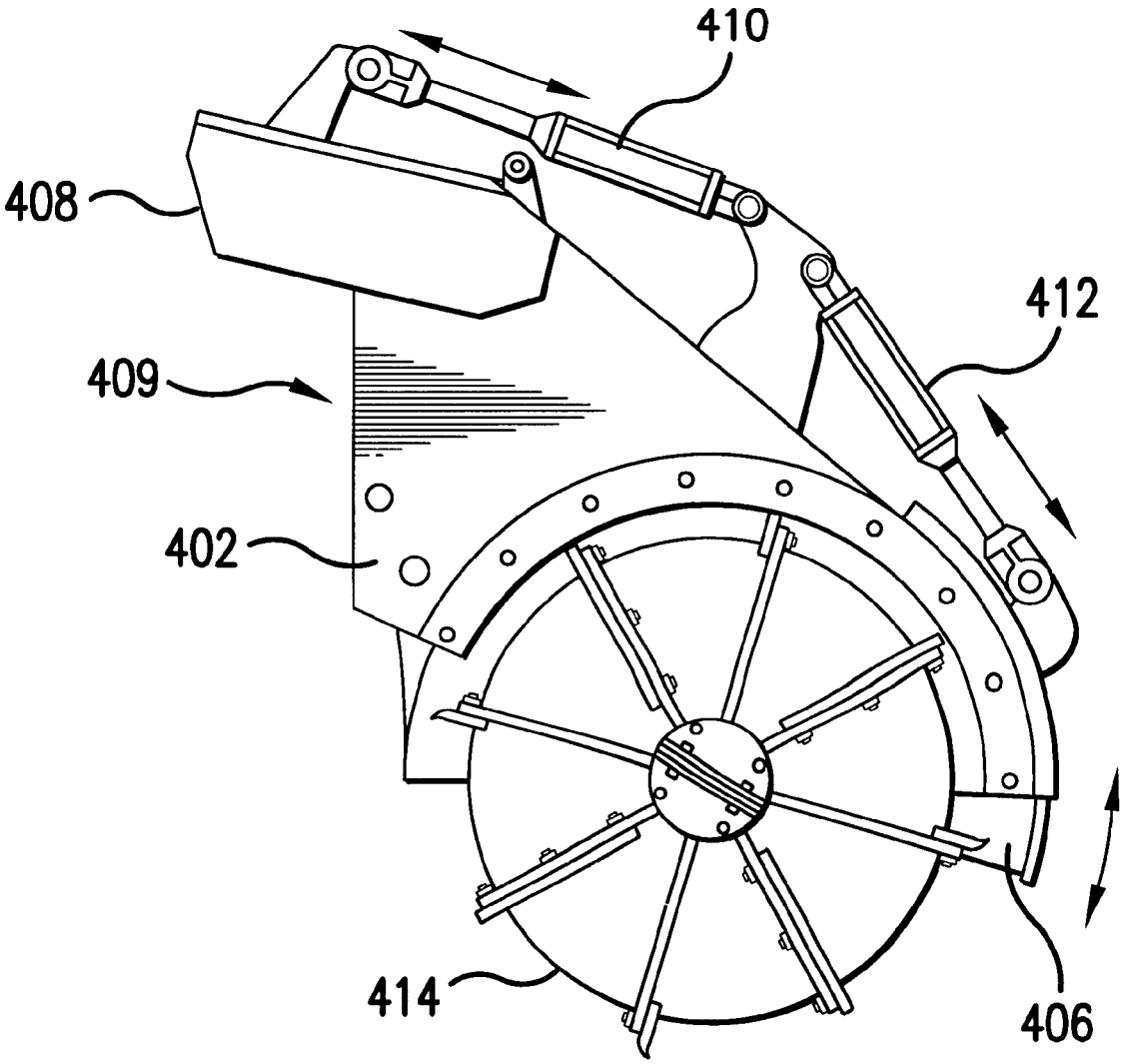

Referring now to FIGS. 29*a* and 29*b*, rotatably connected to the rotary cutting head shield 402 are a rotary cutting head adjustable extension shield 406 and a rotary cutting head adjustable deflector shield 408. The adjustable extension shield 406 may be extended in varying amounts as shown in FIGS. 29*a* and 29*b*. The adjustable extension shield 406 is extended when making excavations less than one half of the diameter of the rotor 414. This prevents excavated material from moving toward the excavator 10 and the laser equipment 500. The adjustable extension shield 406 is used when the rotor 414 is excavating with either a clockwise or counter-clockwise rotation.

An adjustable extension shield cylinder 412 actuates position of the adjustable extension shield 406. The ram end of the cylinder 412 is connected to the adjustable extension shield 406 and the cylinder end is connected to a mounting bracket on the rotary cutting head shield 402.

The rotary cutting head adjustable deflector shield 408 controls the trajectory of spoil material as it exits the shield outlet 409, and it protects the laser assembly 500 from flying objects. The position of the deflector shield 408 is controlled by a deflector shield hydraulic cylinder 410. The ram end of the cylinder 410 is connected to the deflector shield 408 and the cylinder end is connected to the cutting head shield 402.

Referring now back to FIG. 3, the vertical telescopic stationary boom 304 rotates with respect to the lateral telescopic extendable boom 202 about the vertical telescopic boom pivot pin 310. A vertical telescopic boom pendulous sensing device 306 is attached to the vertical telescopic stationary boom 304. FIG. 3 further shows the attachment of the laser equipment 500. A laser alignment control receiver mounting bracket 504 is attached to the vertical telescopic extendable boom 302. Attached to the laser alignment control receiver mounting bracket 504 is a laser alignment control receiver position adjustment tube 506. Slidably attached to the laser alignment control receiver position adjustment tube 506 is the laser alignment control receiver 502. Also attached to the vertical telescopic extendable boom 302 is a vertical sensing depth control laser receiver mount 510. Slidably connected to the laser receiver mount 510 is the vertical sensing depth control laser receiver 508.

Figure 4:
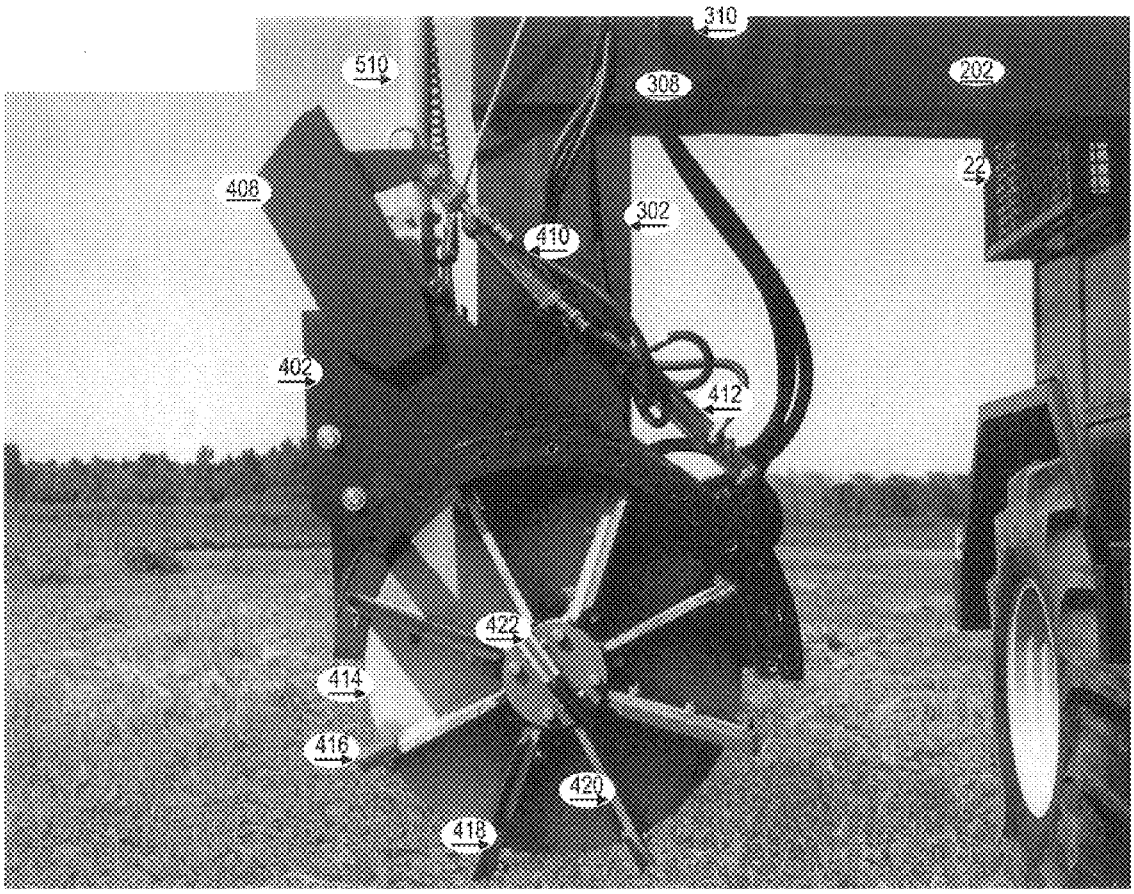
FIG. 4 is a front view of the rotary cutting head rotor.

FIG. 4 is a front view of the rotary cutting head assembly 400. Also shown is the rotary cutting head adjustable extension shield cylinder 412 which is rotatably connected at one end to a mounting bracket attached to the rotary cutting head shield 402 and which is rotatably connected at its other end to the rotary cutting head adjustable extension shield 406. Also shown is the rotary cutting head adjustable deflector shield hydraulic cylinder 410 which is rotatably connected at one end to a mounting bracket attached to the rotary cutting head shield 402 and is rotatably connected at its other end to the rotary cutting head adjustable deflector shield 408. FIG. 4 further displays the vertical telescopic boom pivot arm 308 and the vertical telescopic boom pivot pin 310. The vertical telescopic boom pivot arm 308 is attached to the lateral telescopic extendable boom 202. The vertical telescopic stationary boom 304 is rotatably connected to the vertical telescopic boom pivot pin 310 via the vertical telescopic boom pivot arm 308.

Figure 5:
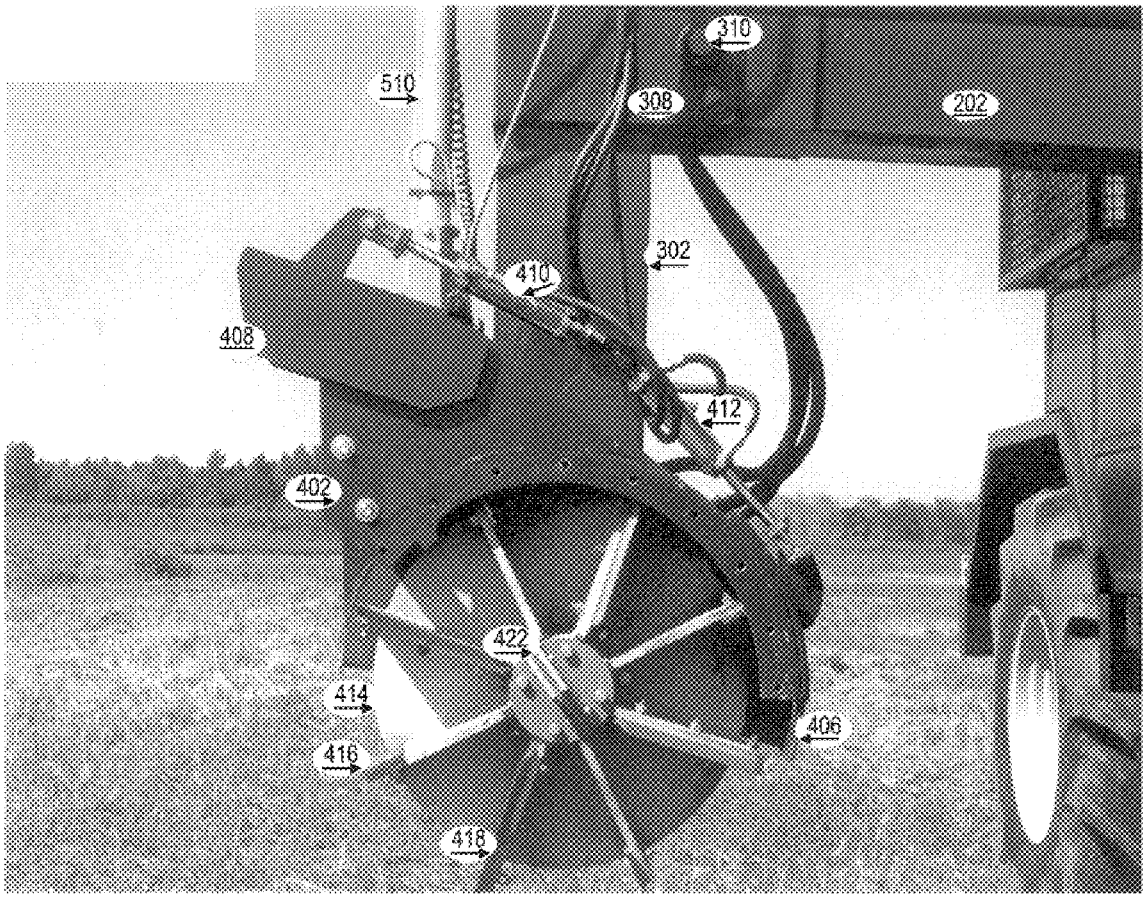
FIG. 5 is a front view of the rotary cutting head rotor showing the adjustable extension shield in the extended position and the rotary cutting head adjustable deflector shield in a deflected position.

FIG. 5 is a front view of the rotary cutting head rotor 414 showing the rotary cutting head adjustable extension shield 406 in the extended position and the rotary cutting head adjustable deflector shield 408 in a deflected position.

Figure 6:
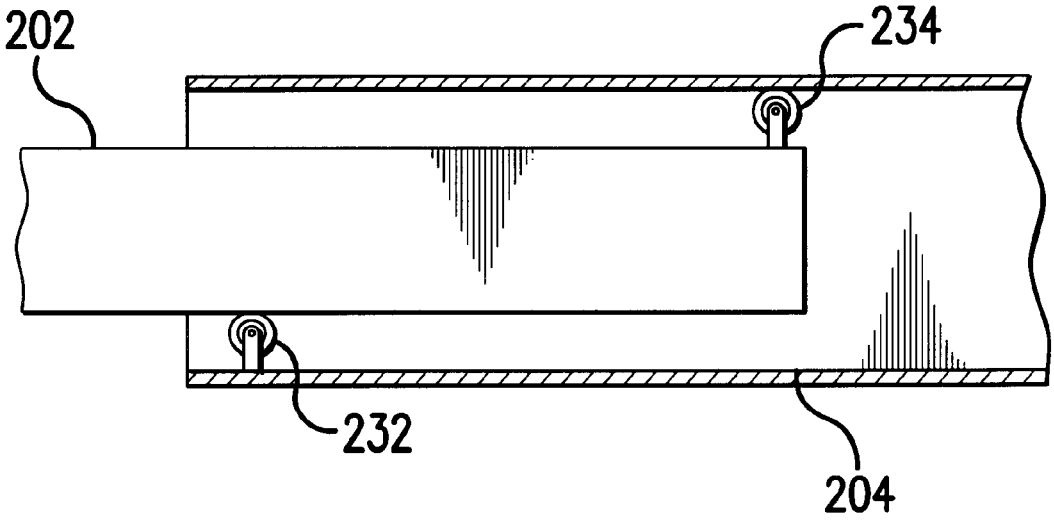
FIG. 6 is a partial sectional view of the lateral telescopic extendable boom and the lateral telescopic stationary boom.

FIG. 6 is a partial sectional view of the lateral telescopic extendable boom 202 and the lateral telescopic stationary boom 204. FIG. 6 shows the interaction of a lateral telescopic extendable boom internal roller 234 rotatably connected to the lateral telescopic extendable boom 202. The lateral telescopic extendable boom internal roller 234 is in rolling contact with an interior surface of the lateral telescopic stationary boom 204. Likewise the lateral telescopic stationary boom roller 232 which is rotatably mounted on the lateral telescopic stationary boom 204 is in rolling contact with an outer surface of the lateral telescopic extendable boom 202.

Figure 7:
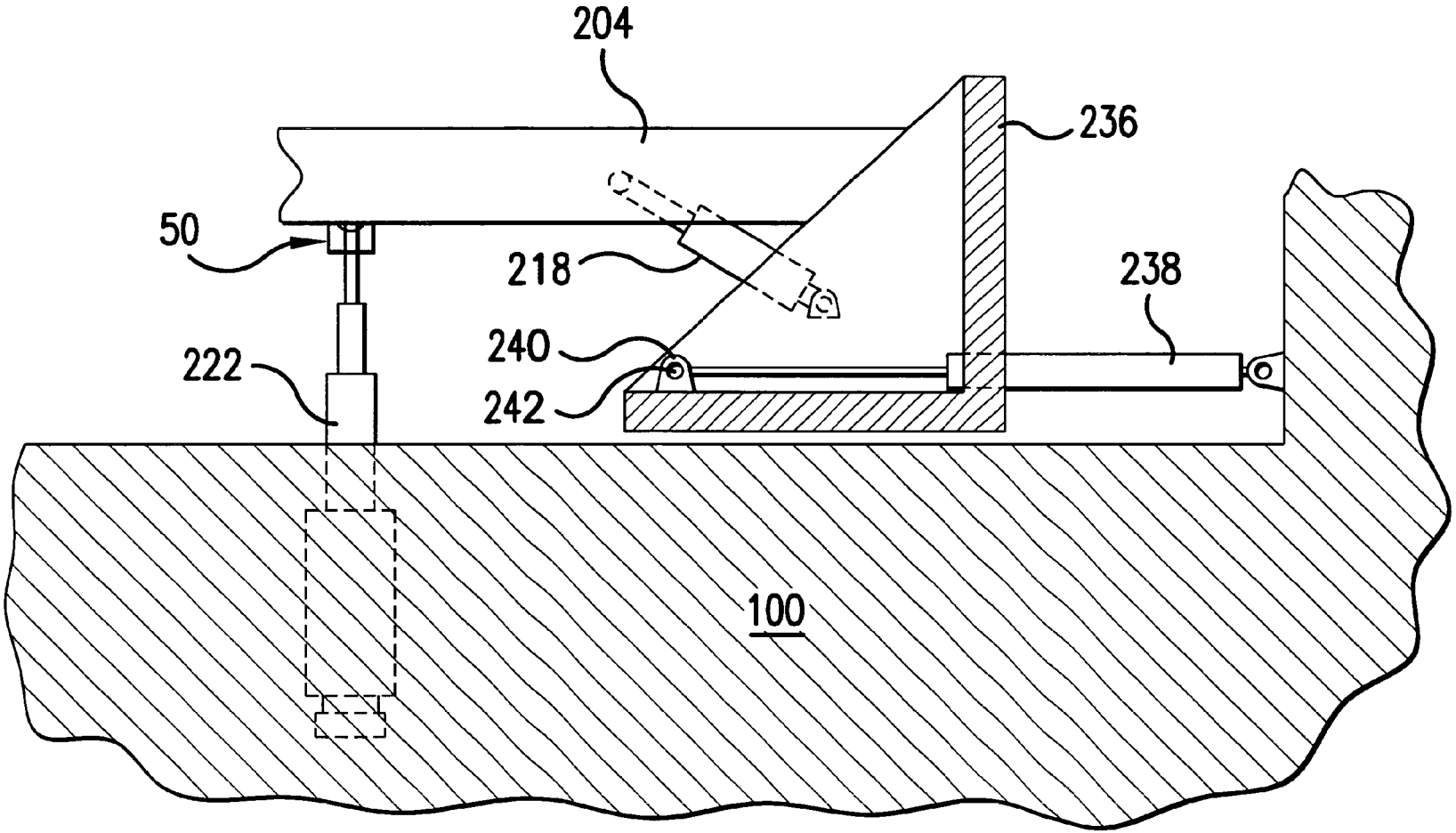
FIG. 7 is a partial view of the lateral boom base mounting assembly.

FIG. 7 is a partial view of the lateral boom base mounting assembly 236. The lateral telescopic stationary boom 204 is rotatably connected to the lateral boom base mounting assembly 236. The lateral boom base mounting assembly 236 is in turn slidably mounted on the frame 100. A lateral boom deck extension hydraulic cylinder 238 is connected at one end to the frame 100 and at its other end to the lateral boom base mounting assembly 236. Both the forward and rear twin lateral boom hydraulic cylinders 216 (cylinder 216 is not visible in FIG. 7 because it is obscured by the identical cylinder 218—cylinder 216 is partially visible in FIG. 11), 218 are rotatably connected at one of each of their ends to the lateral boom base mounting assembly 236 and the remaining end of each are rotatably connected to the lateral telescopic stationary boom 204. A four-stage lateral boom hydraulic cylinder 222 is rotatably connected to the frame 100. The other end of the four stage lateral boom hydraulic cylinder 222 is rotatably connected to a lateral boom rest 50. The lateral boom rest 50 contacts the lateral telescopic stationary boom 204.

Figure 8:
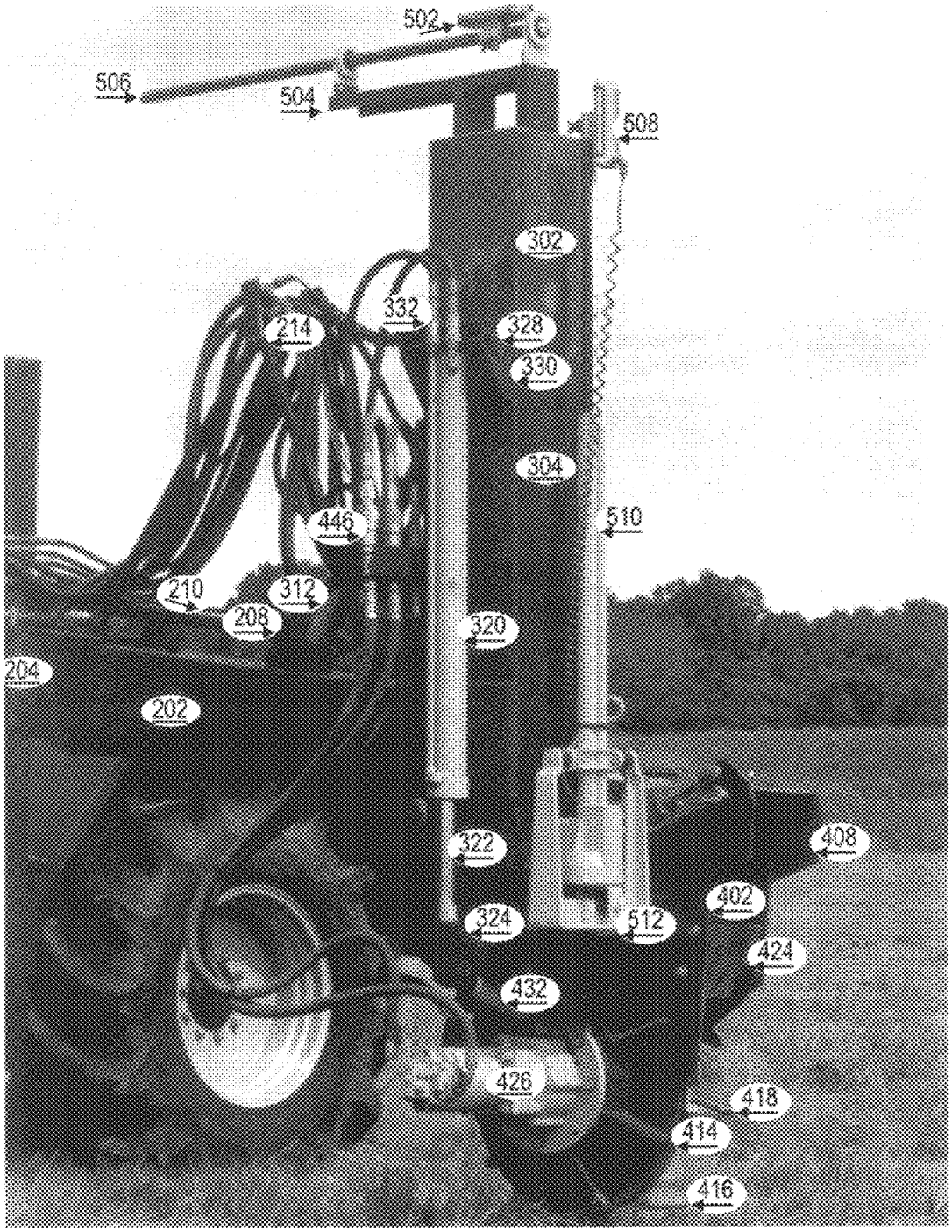
FIG. 8 is a perspective view of an embodiment of the invention from a different angle as compared to FIG. 1.

FIG. 8 is a perspective view of an embodiment of the invention from a different angle as compared to FIG. 1. FIG. 8 provides a partial rear view of the rotary cutting head assembly 400. The rotary cutting head rotor 414 is shown with rotary cutting head rotor impeller blades 416 and rotary cutting head rotor blades 418 attached to the rotary cutting head blade mounting brackets 420. Also shown is the rotary cutting head hydraulic drive motor 426.

The laser receiver mount 510 attaches to the vertical boom assembly 300 through a telescoping laser depth control receiver mounting base 512.

A vertical telescopic boom hydraulic cylinder 320 is attached to the vertical telescopic stationary boom 304. Slidably mounted in the vertical telescopic boom hydraulic cylinder 320 is a vertical telescopic boom hydraulic cylinder ram 322. An end of the vertical telescopic boom hydraulic cylinder ram 322 is pivotally connected to a vertical telescopic boom hydraulic cylinder ram pin 324 which is connected to the rotary cutting head assembly 400.

The angular position of the rotary cutting head assembly 400 is adjustable via a rotary cutting head position adjustment turnbuckle 432. The rotary cutting head position adjustment turnbuckle 432 is pivotally connected at each of its ends, one end connected to the rotary cutting head assembly 400 and the other end connected to the vertical telescopic extendable boom 302. The vertical telescopic boom hydraulic cylinder 320 is fitted with vertical telescopic boom hydraulic cylinder quick release hydraulic hose connectors 332. Additionally, the rotary cutting head assembly 400 is equipped with rotary cutting head hydraulic hose quick coupler connectors 446.

Figure 9:
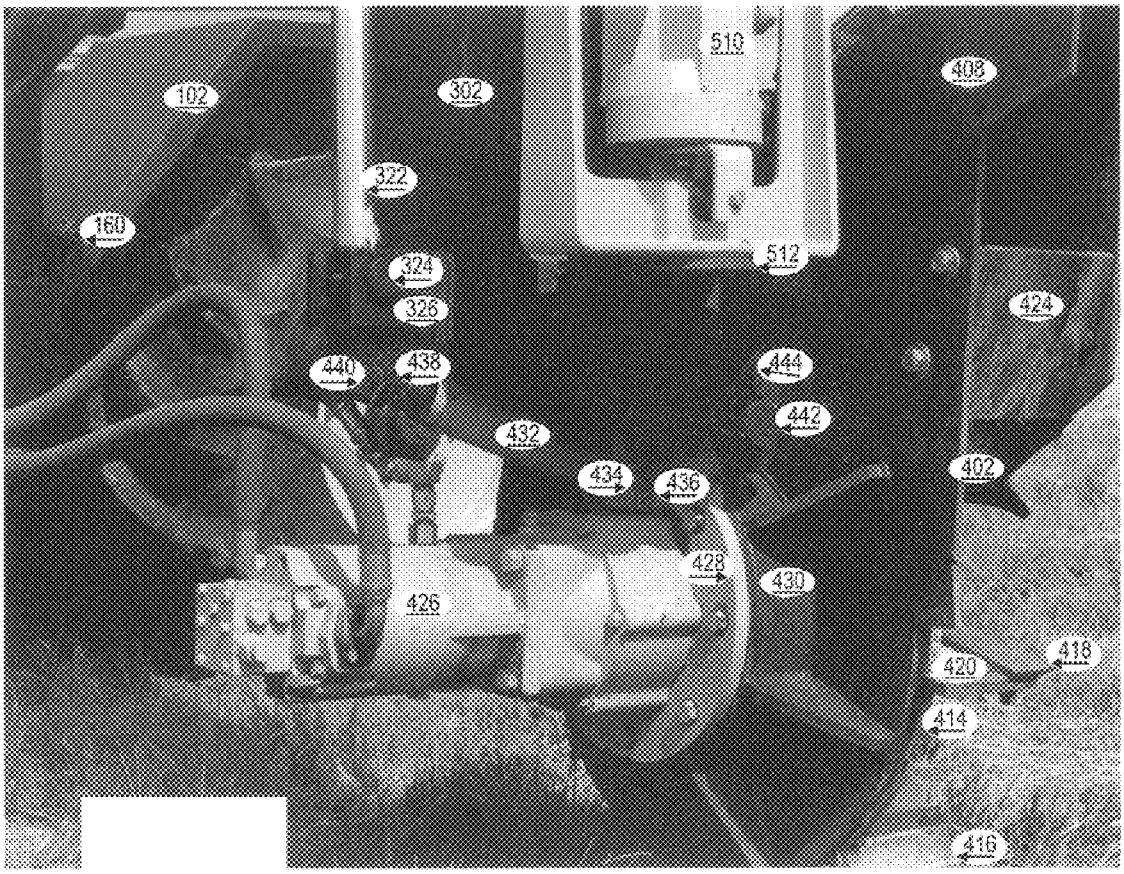
FIG. 9 is a perspective view of the rotary cutting head rotor.

FIG. 9 is a perspective view of the rotary cutting head assembly 400. The rotary cutting head shield housing 430 is shown. Attached to the rotary cutting head shield housing 430 is a rotary cutting head mounting plate 428. Attached to the rotary cutting head mounting plate 428 is a gearbox and the rotary cutting head hydraulic drive motor 426.

Figure 10:
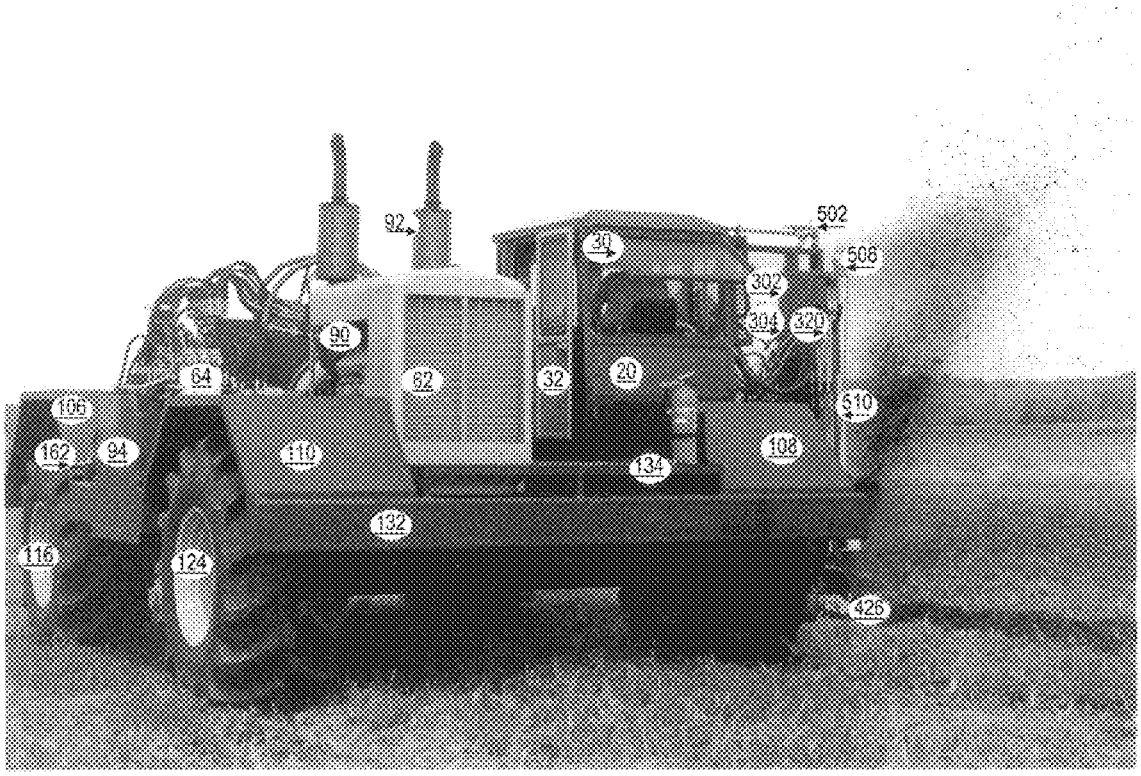
FIG. 10 is a perspective view from the rear of an embodiment of the invention.

FIG. 10 is a perspective view from the rear of an embodiment of the self-propelled rotary excavator 10 of FIG. 1. Shown is the rear vehicle frame beam 132 of the frame 100. Also shown are the left rear fender 110 attached to the frame 100. The diesel engine 90 and expanded steel muffler safety shields 92 and diesel fuel tank 94 are also mounted on the frame 100. Further illustrated are the left front wheel 116 and the left rear wheel 124 along with the left front fender 106. On the left side of the self-propelled rotary excavator is a left high pressure water coupling receptacle 162 and priority flow regulator valves 64. On the right hand side of the self-propelled rotary excavator 10 sets the cab 20 mounted on the frame 100. The cab 20 includes a cab door 32 and an upper hinged rear window 30. Also shown are the deck grating 134 and right rear fender 108 both mounted on the frame 100.

Figure 11:
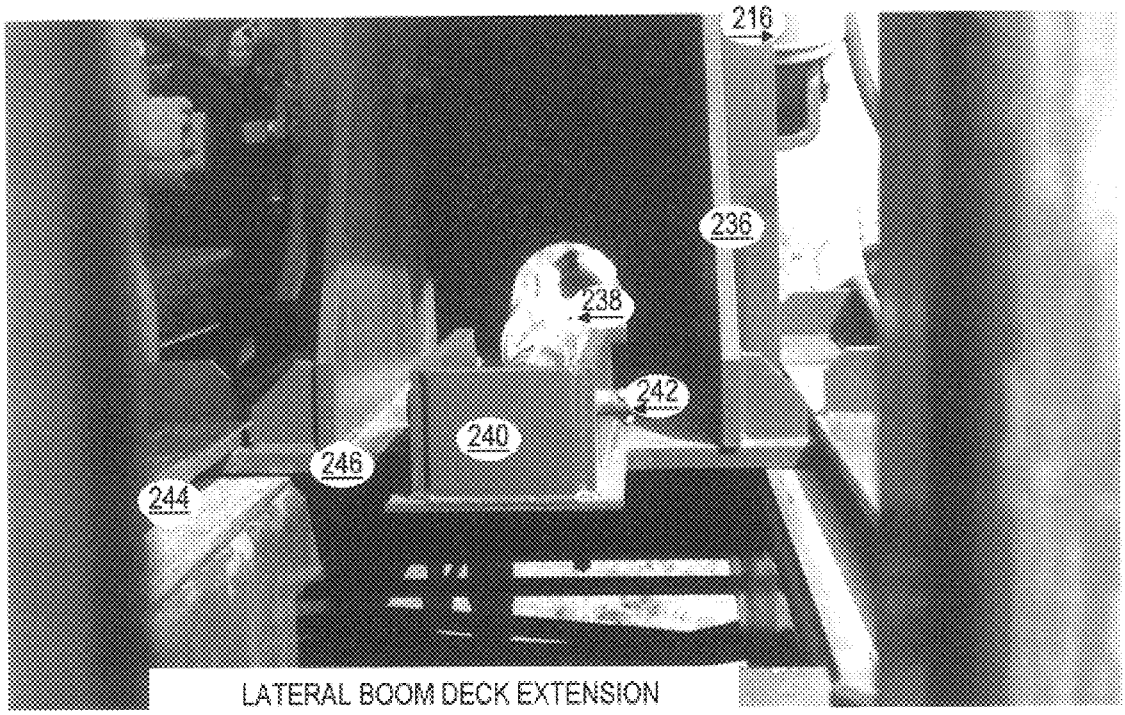
FIG. 11 is a side view of the lateral boom deck extension.

FIG. 11 is a side view of FIG. 7. FIG. 11 shows the lateral boom deck extension sliding base plate 246 slidably mounted on the frame 100. The lateral boom deck extension sliding base plate 246 is constrained by the lateral boom deck extension guide 244 which is fixedly attached to the frame 100. Mounted on the lateral boom deck extension sliding base plate 246 is a lateral boom deck extension hydraulic cylinder mounting bracket 240. Mounted on the lateral boom deck extension hydraulic cylinder mounting bracket 240 is a lateral boom deck extension hydraulic cylinder ram pin 242. Rotatably connected to the lateral boom deck extension hydraulic cylinder ram pin 242 is a lateral boom deck extension hydraulic cylinder 238. The other end of the lateral boom deck extension hydraulic cylinder 238 is connected to the frame 100. A perspective view of the lateral boom base mounting assembly 236 can be seen with reference to FIG. 37.

Figure 12:
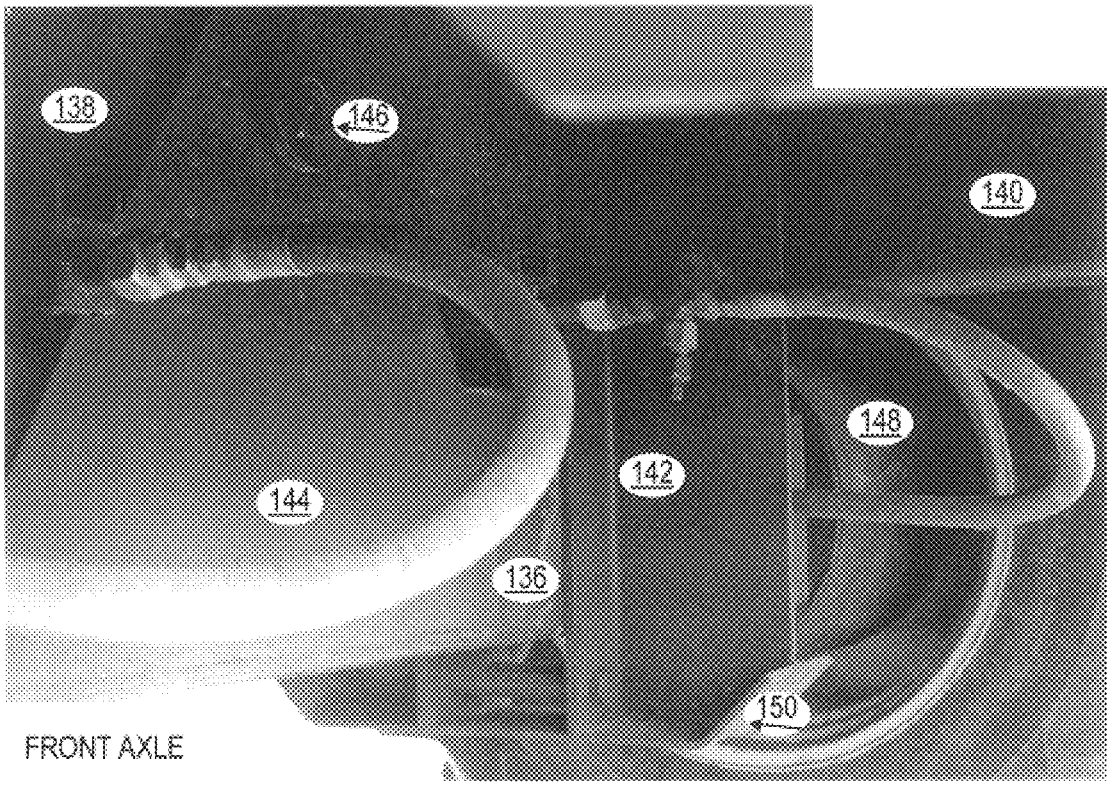
FIG. 12 is a view of the axle attachment to the chassis.
Figure 33A:
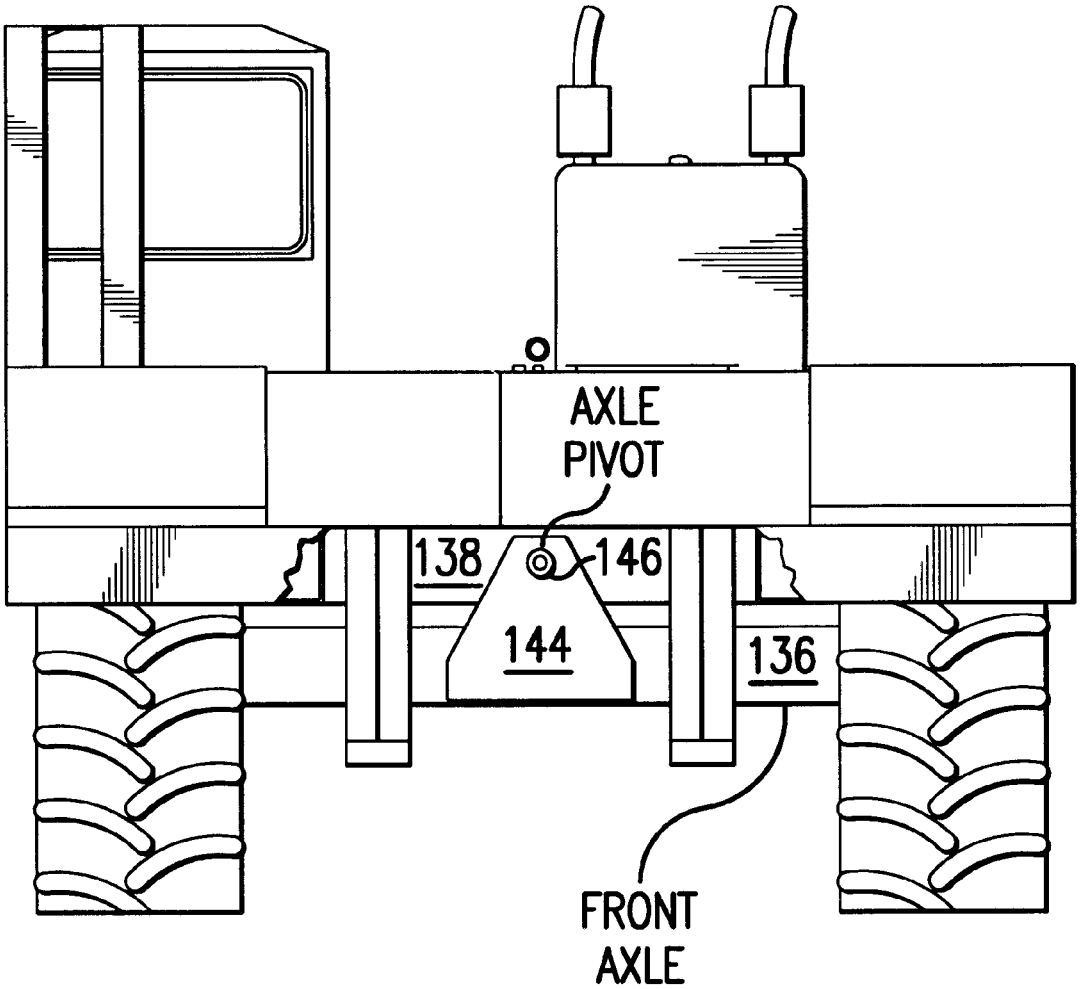
FIGS. 33*a–c* are partial perspective views of the rotary excavator of FIG. 1 showing a front axle.
Figure 33B:
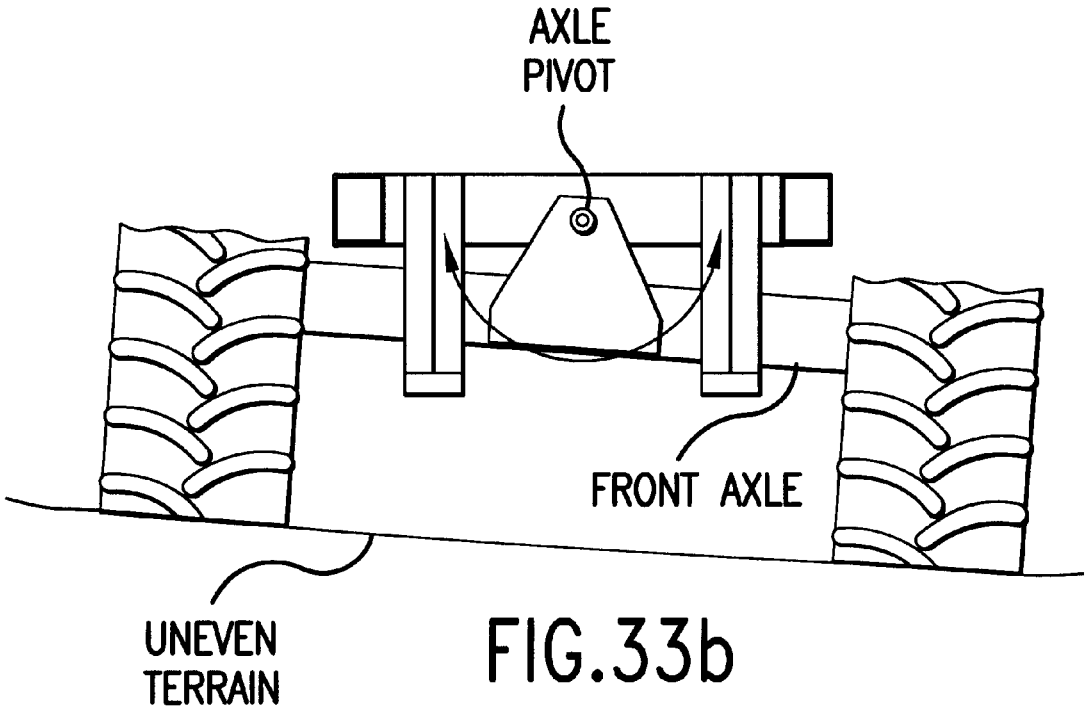
Figure 33C:
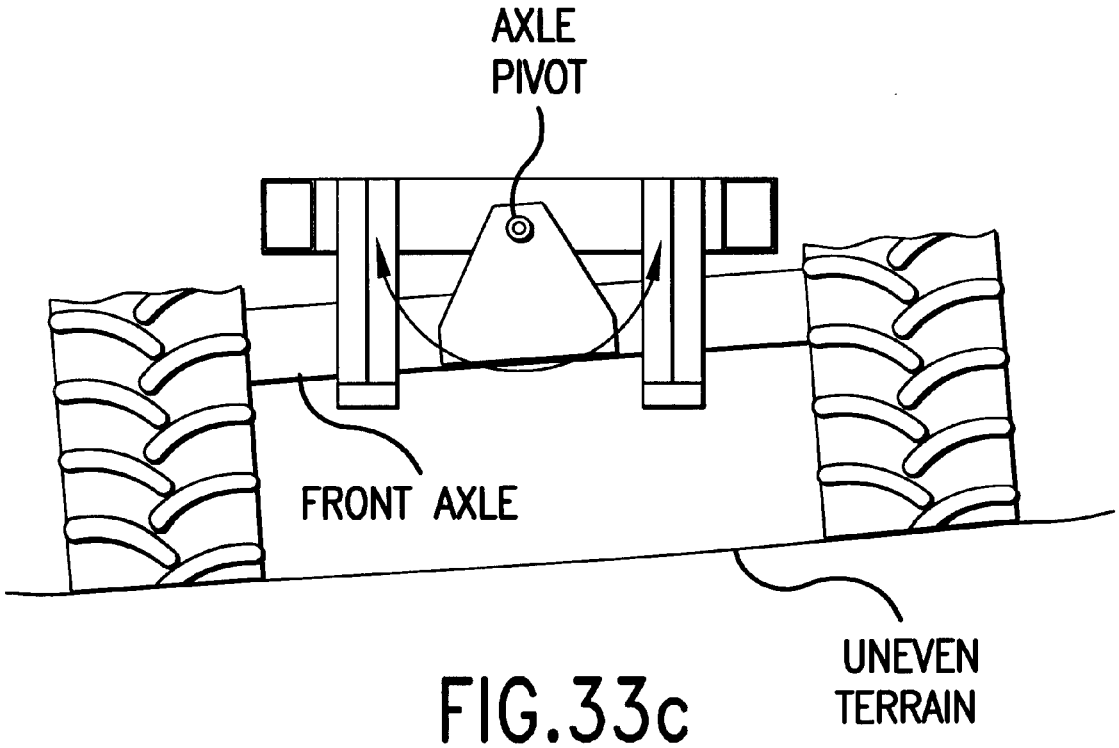

FIG. 12 is a perspective view of the attachment of the front axle 136 to the frame 100 as viewed from just below the front vehicle frame beam 104 of FIG. 1. Shown is a front axle frame section 138 of the frame 100. A triangular plate 144 is welded to both the front and rear of the axle 136. The triangular plate 144 is pivotally mounted to the frame section 138 by a front axle hinge pin 146. A left-front vertical axle guide 142 constrains the fore and aft movement of the front axle 136, while allowing the front axle 136 to rotate about front axle hinge pin 146. As can be seen with reference to FIGS. 33*a*, 33*b* and 33*c*, this arrangement allows the axle 136 to pivot on uneven terrain. The rear axle 137 is not mounted to provide such pivot action.

Figure 34:
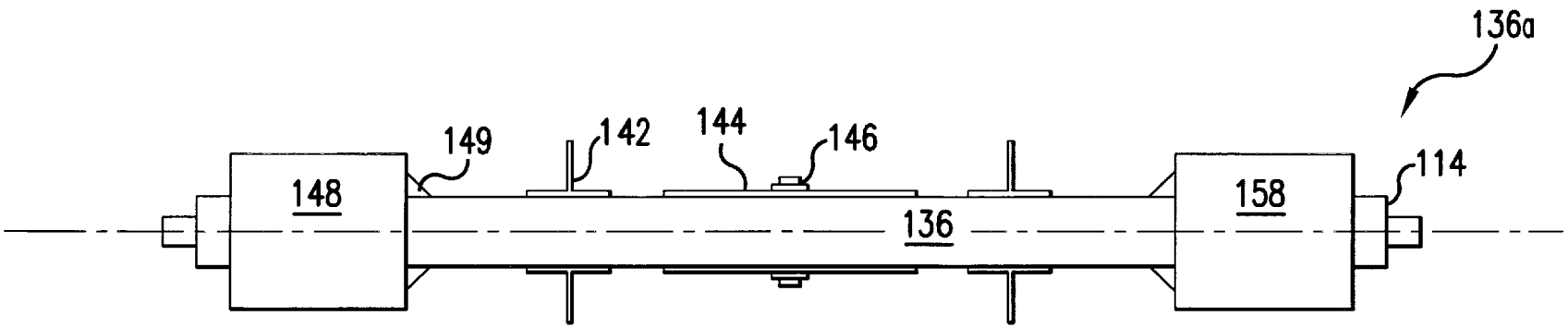
FIG. 34 is a top view of a front axle assembly.
Figure 35:
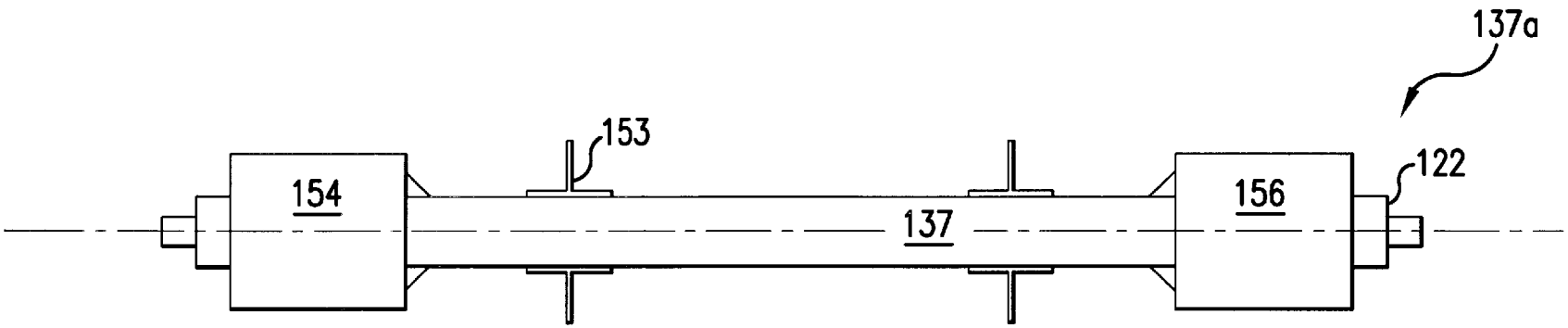
FIG. 35 is a top view of a rear axle assembly.

Referring now back to FIG. 12, connected to the front axle 136 is a left-front hydraulic wheel drive motor mounting assembly 148. A left-front side frame 140 attaches to the frame 100. Each of the four wheels 112, 116, 120, 124 have a similar construction. A top view of the front axle assembly 136*a* is shown in FIG. 34 and a top view of the rear axle assembly 137*a* is shown in FIG. 35.

Figure 36:
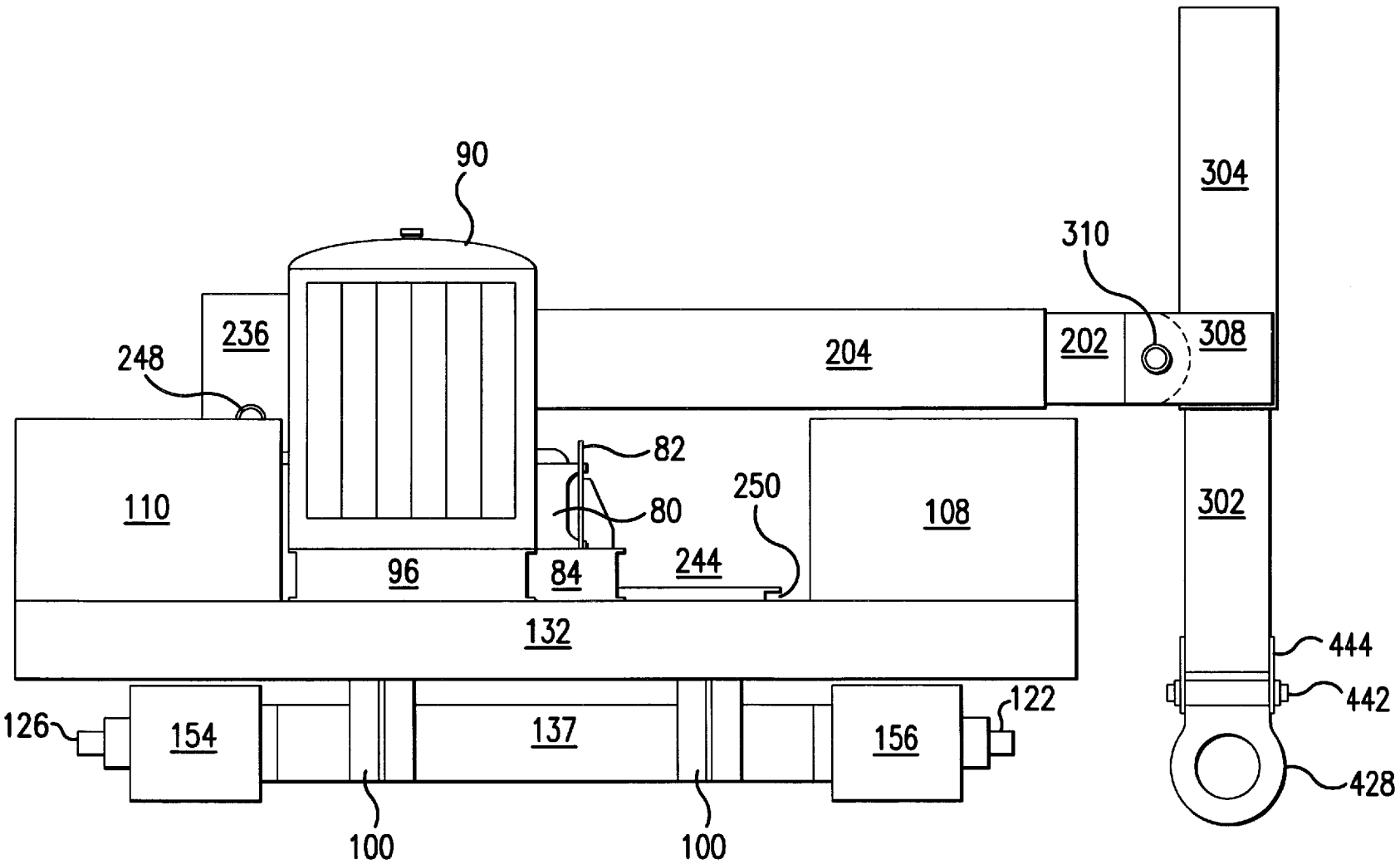
FIG. 36 is a partial rear view of the excavator of FIG. 1 showing a rear axle mounted to a frame.
Figure 37:
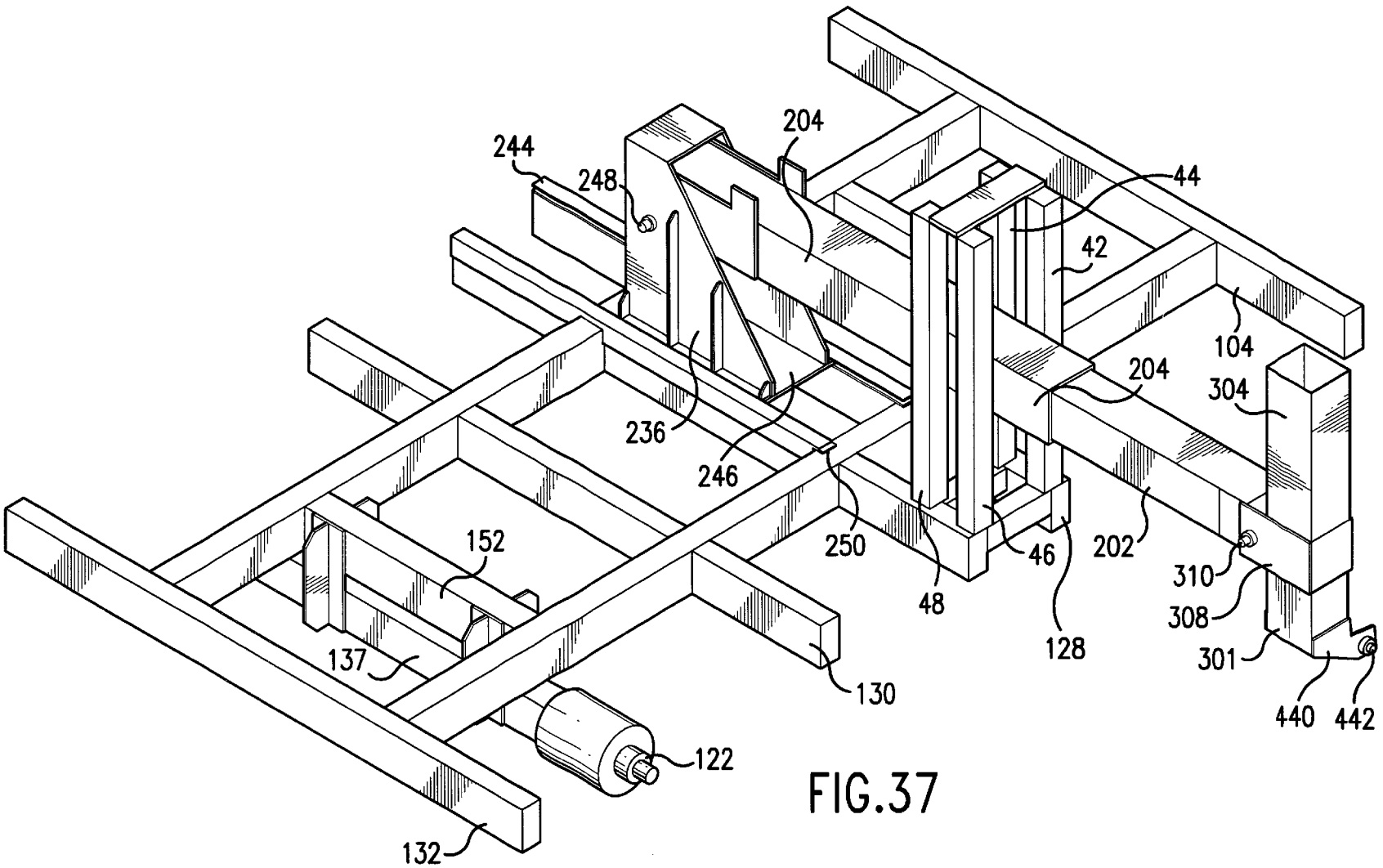
FIG. 37 is a perspective view of the frame of the excavator of FIG. 1.

Again referring back to FIG. 12, the front axle frame section 138 is located directly over the front axle 136. The front axle frame section 138 is welded to the left-front side frame 140 and the right-front side frame on the opposite side of the self-propelled rotary excavator 10. The left front vertical axle guide 142, as shown in FIG. 12, and the right front vertical axle guide (not shown), along with a left and right rear vertical axle guide prevent forward or backward movement of the front axle 136 while the self-propelled rotary excavator 10 is moving. The rear axle 137 is mounted directly to the machine frame 100 as shown in FIGS. 36 and 37 and thus does not pivot as discussed above.

As shown in FIG. 12, the left front hydraulic wheel drive motor mounting assembly 148 is attached to the left side of the front axle 136 and contains the left front wheel hydraulic motor which is connected to the left front wheel 116, the other wheels are associated with their own hydraulic motors in a similar fashion.

Associated with the axle guides are a pair of transport mounting pads. A left front transport mounting pad 150 is secured to the left front vertical axle guide 142 and to the left rear vertical axle guide. Another transport mounting pad is secured to the right front vertical axle guide and the right rear vertical axle guide, in a manner similar to that described above. When the self-propelled rotary excavator 10 is transported, the self-propelled rotary excavator 10 can be supported using the mounting pads 150.

Figure 13:
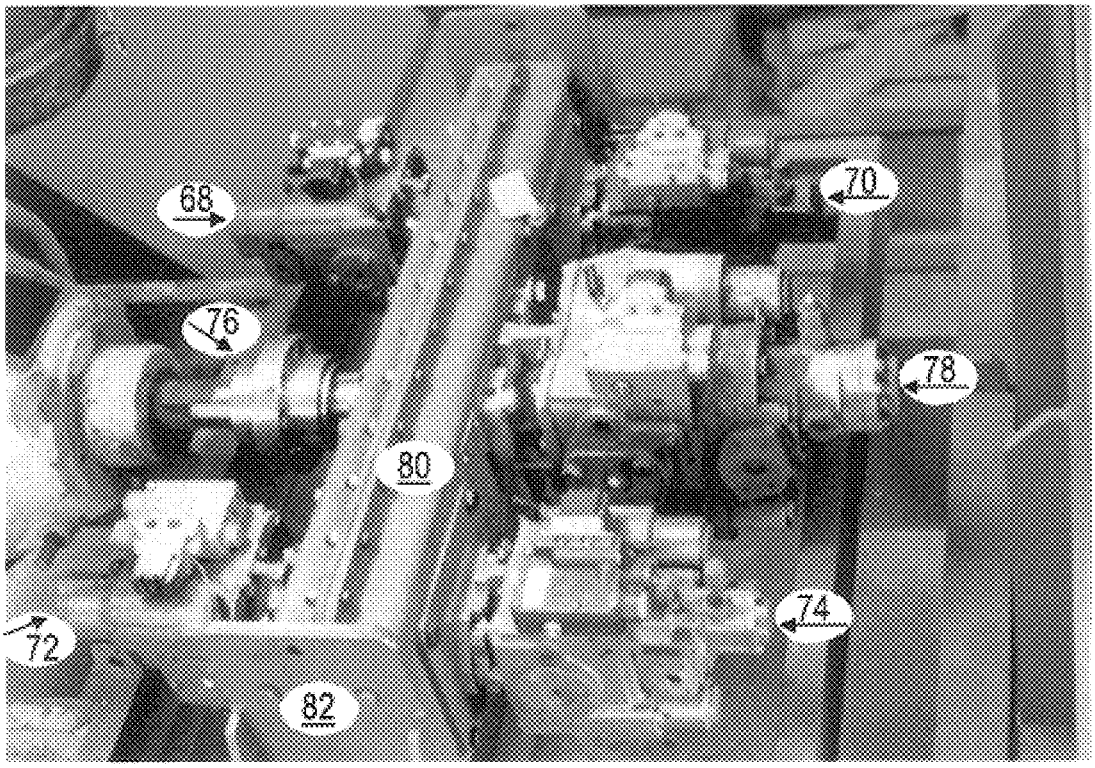
FIG. 13 is a perspective view of the rotary cutting head and wheel drive pumps layout.

FIG. 13 is a perspective view of the layout of the rotary cutting head hydraulic pump 78 and wheel drive pumps 68, 70, 72, 74 layout as viewed from above the self-propelled rotary excavator 10, FIG. 1, while looking at an area just in front of the diesel engine 90. Shown is a drive box mounting bracket 82 attached to the frame assembly 100. Attached to the drive box mounting bracket 82 is a drive box 80. Connected to the drive box 80 are a left rear wheel hydraulic pump 68, a left front wheel hydraulic pump 70, a right rear wheel hydraulic pump 72, a right front wheel hydraulic pump 74, a rotary cutting head hydraulic pump 78 and a drive coupling 76 which attaches to the diesel engine 90.

Figure 14:
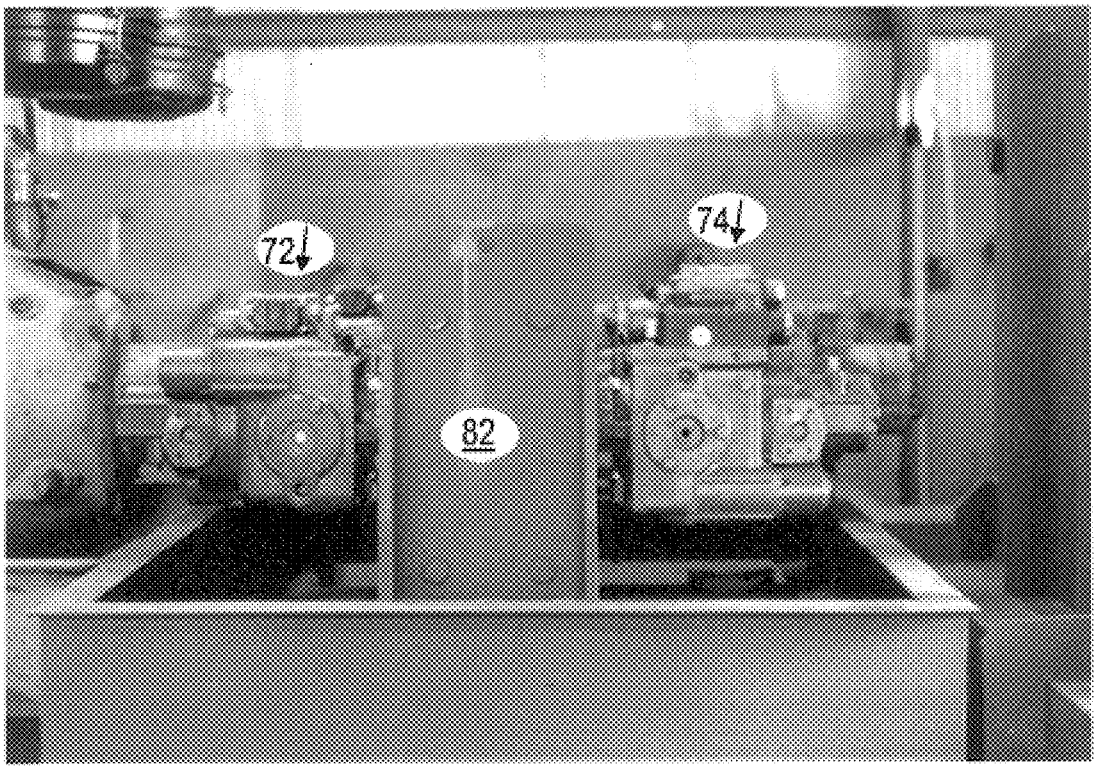
FIG. 14 is a side view of the rotary cutting head and wheel drive pumps layout.

FIG. 14 is a side view of the layout of the rotary cutting head pump and the wheel drive pumps as shown in FIG. 13. The drive box mounting bracket 82 is shown attached to the frame assembly 100. The right rear wheel hydraulic pump 72 and the right front wheel hydraulic pump 74 are shown from the side.

Figure 15:
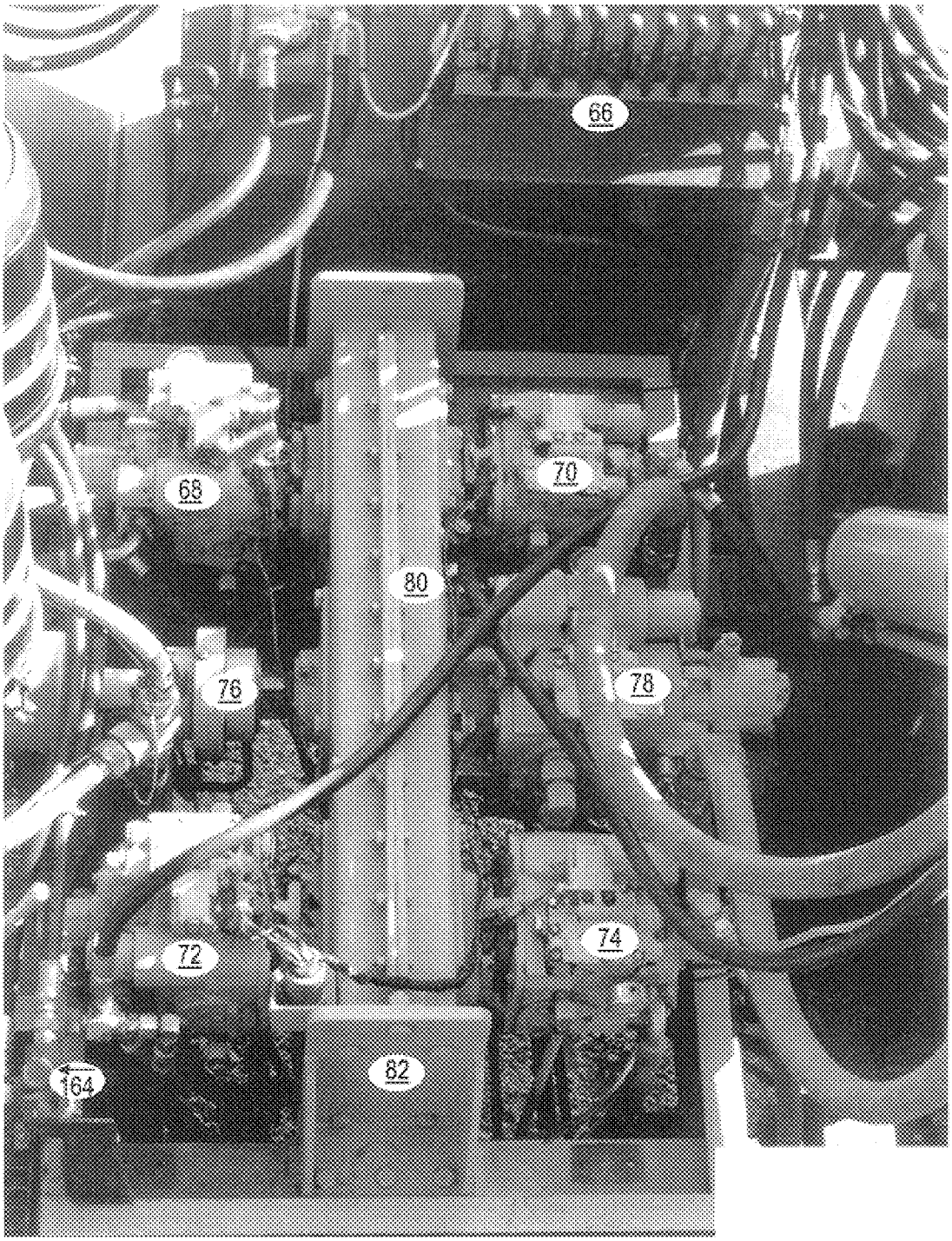
FIG. 15 is a perspective view of the rotary cutting head and wheel drive pumps layout displaying connection of the hydraulic tubing.

FIG. 15 is a perspective view of the layout of the rotary cutting head pump and wheel drive pumps as shown in FIG. 13 while displaying hydraulic tubing connections. Also shown is the valve bank 66 attached to the frame assembly 100.

Figure 16:
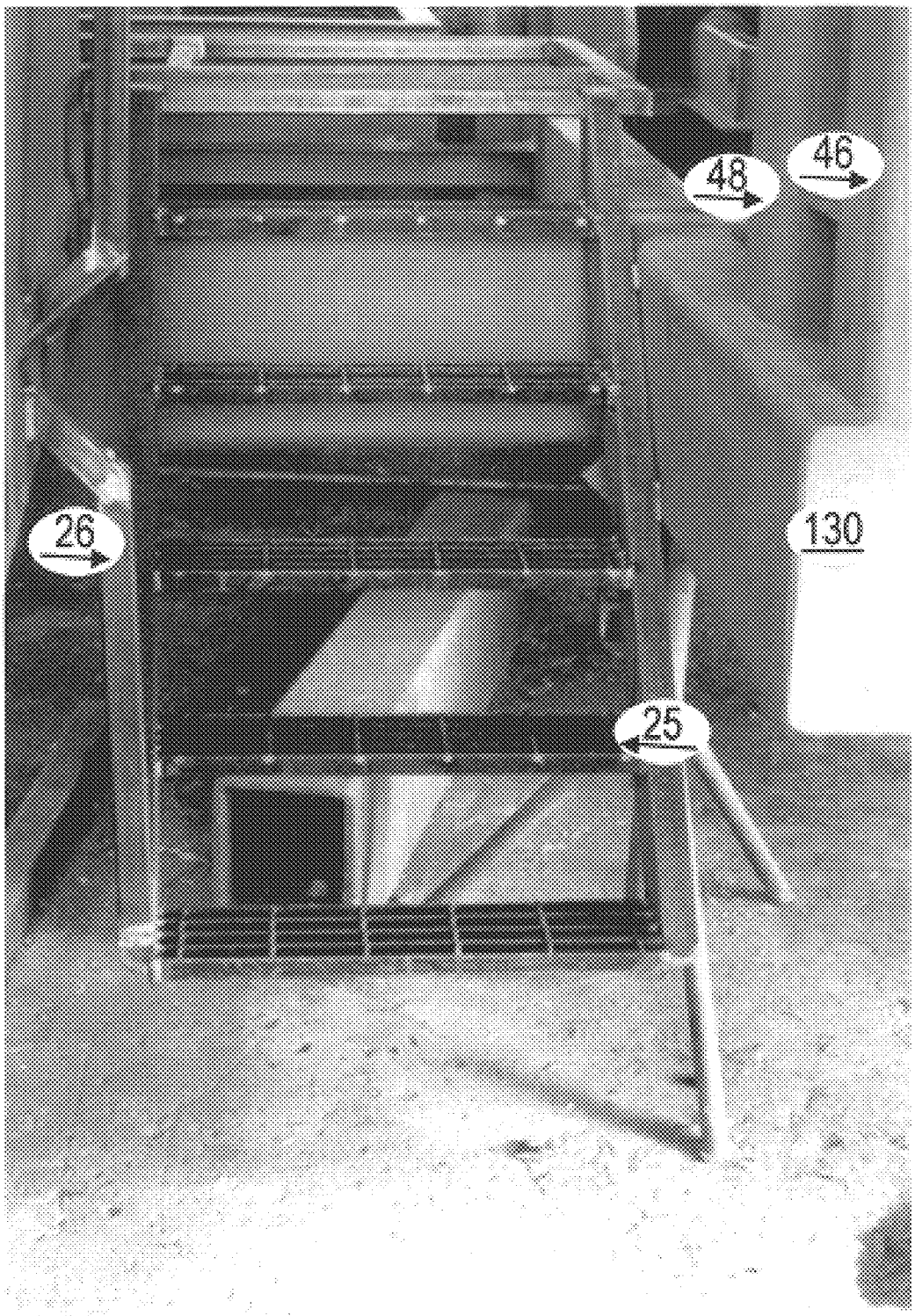
FIG. 16 is a view of the steps and safety handrail.

FIG. 16 is a view of the grated steps 25 and the safety handrail 26 attached to the frame assembly 100. Also shown is a rear-central frame section 130 of the frame assembly 100. Attached to the rear-central frame section 130 are the right rear lateral boom vertical guide 46 and the left rear lateral boom vertical guide 48.

Figure 17:
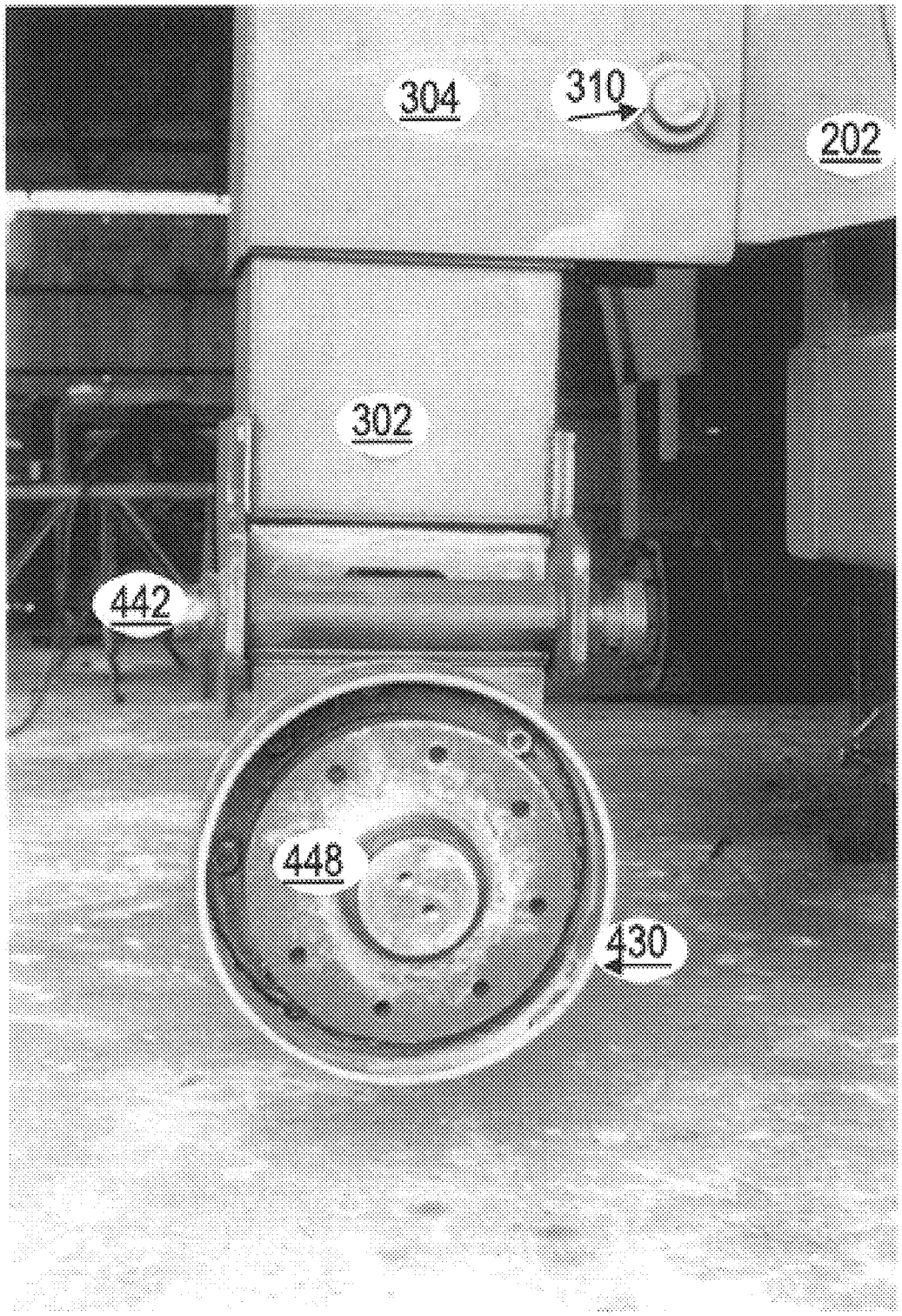
FIG. 17 is a front view of the rotary cutting head rotor hub.

FIG. 17 is a front view of the rotary cutting head rotor hub 448 with the rotary cutting head rotor 414 removed, and the rotary cutting head mounting pin 442 is shown. Also shown is the vertical telescopic boom pivot pin 310 which allows the vertical telescopic stationary boom 304 to pivot relative to the lateral telescopic extendable boom 202.

Figure 18:
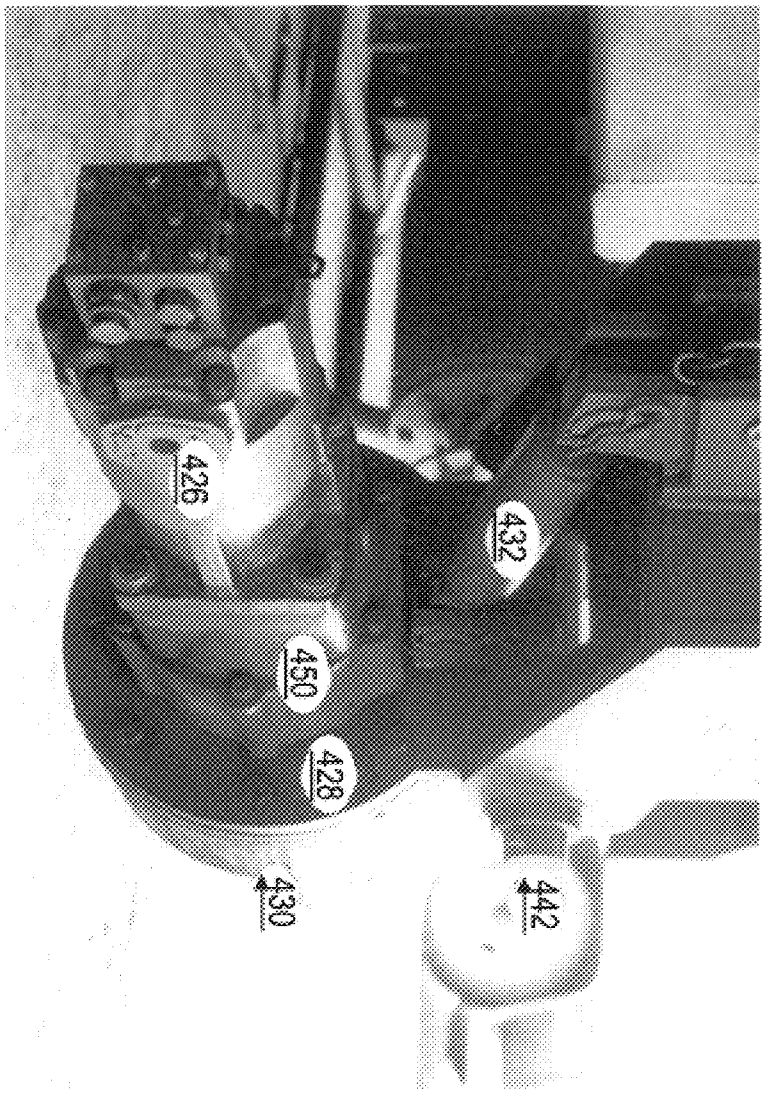
FIG. 18 is perspective view of the rotary cutting head rotor and displaying the rotary cutting head position adjustment turnbuckle and rotary cutting head hydraulic motor and gear box.

FIG. 18 is a perspective view of the rotary cutting head assembly 400 which displays the rotary cutting head position adjustment turnbuckle 432 and the rotary cutting head hydraulic drive motor 426 and associated gear box 450 attached to the rotary cutting head mounting plate 428.

Figure 19:
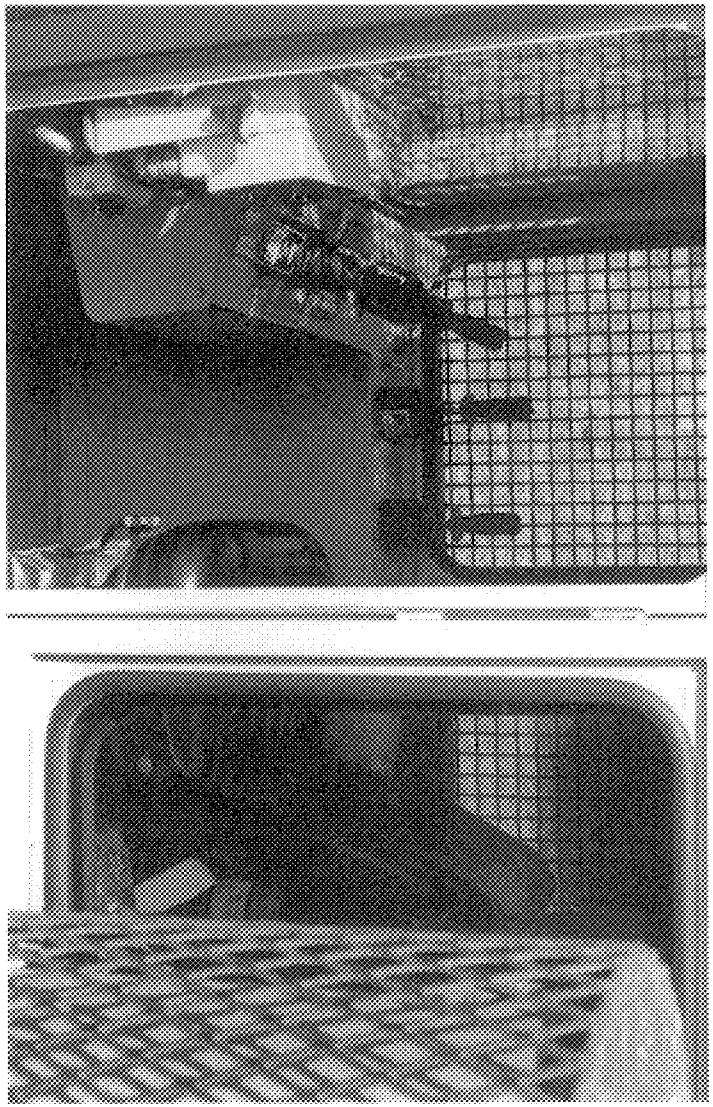
FIG. 19 is a view of the interior of the cab.
Figure 20:
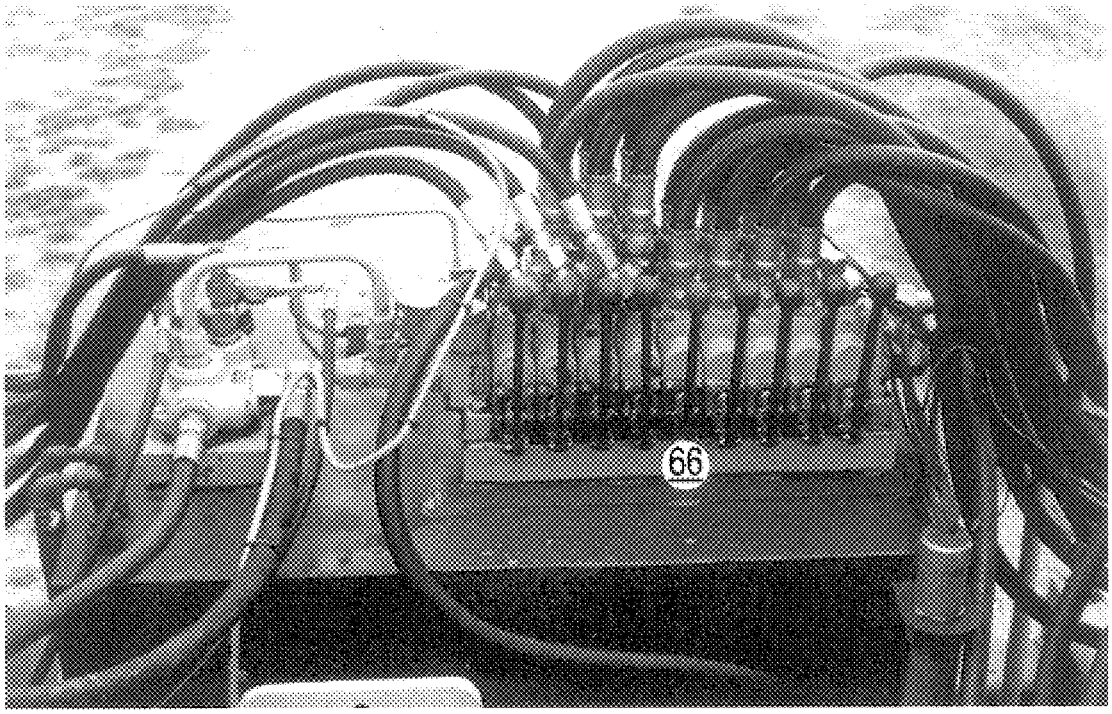
FIG. 20 is a view of the sectional valve bank.
Figure 21:
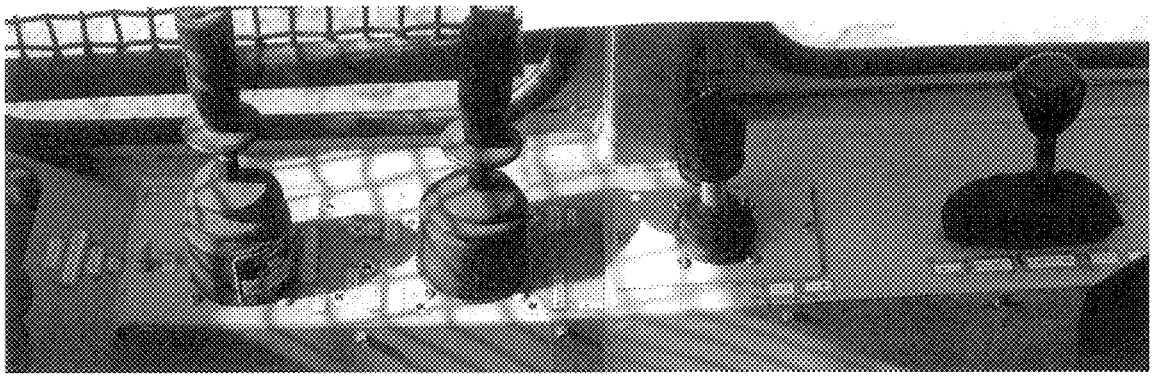
FIG. 21 is a view of the excavator controls inside the cab.
Figure 22:
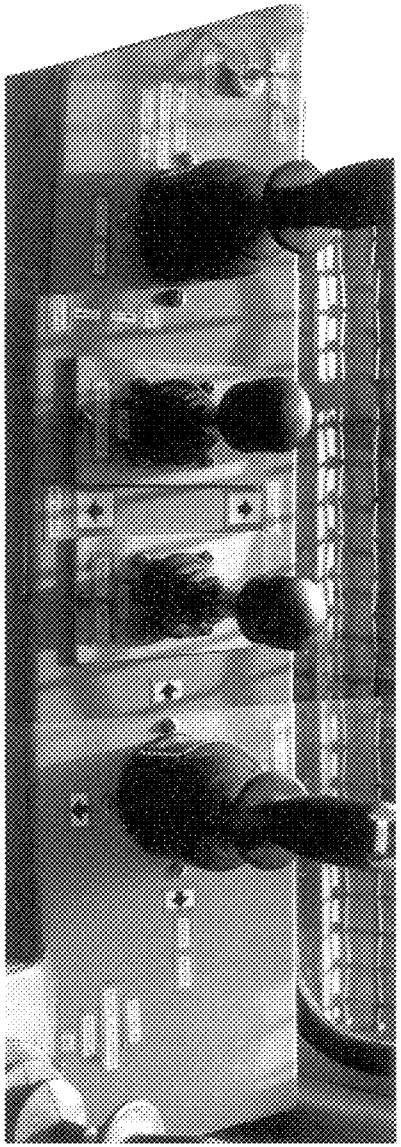
FIG. 22 is a view of the excavator controls.
Figure 23:
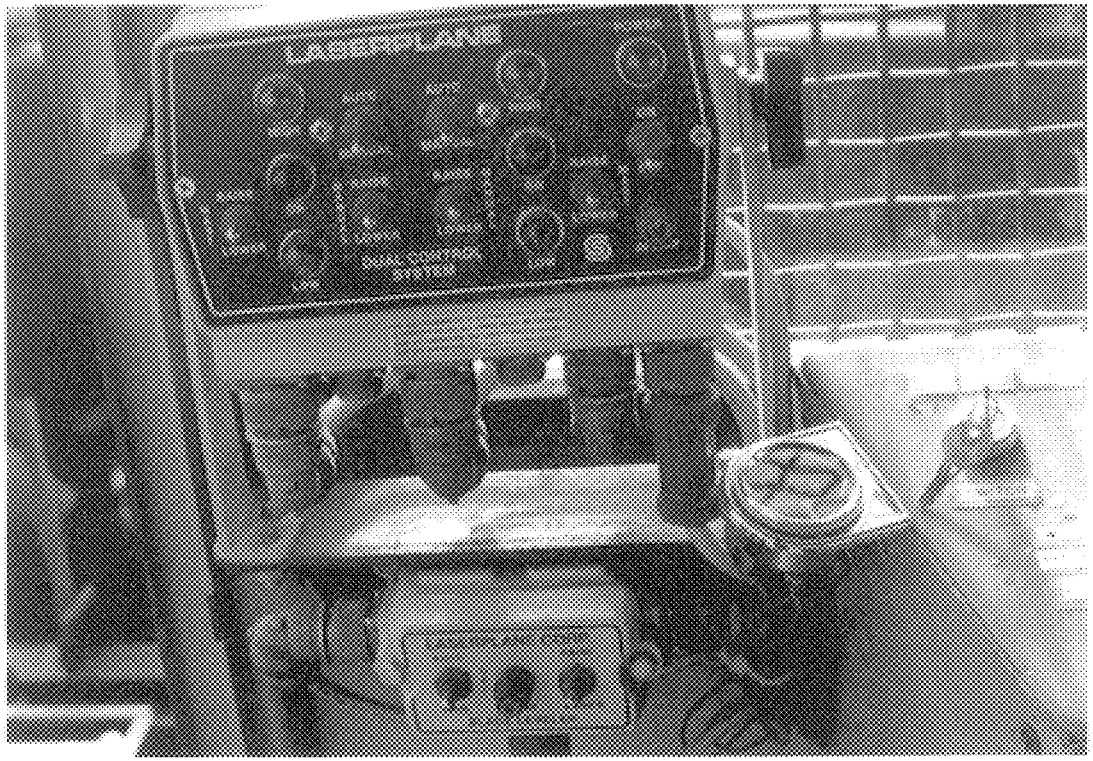
FIG. 23 is a view of the laser controls.

FIG. 19 is a view of the interior of the cab 20 attached to the frame assembly 100. FIG. 20 is a view of the sectional valve bank 66 attached to the frame assembly 100. The sectional valve bank 66 includes the valves necessary to operate the lateral and vertical boom assemblies 200, 300 and move the self propelled rotary excavator 10. FIG. 21 is a view of the self-propelled rotary excavator controls located inside the cab 20. The controls of FIG. 21 are used to manipulate the boom assemblies 200, 300 and the portions of rotary cutting head assembly 400 and other portions of 400 not controlled by the controls shown in FIG. 22 and are thus oriented in that direction. FIG. 22 is a view of further controls within the interior of the cab 20 for manipulating the pumps 68, 70, 72, 74 associated with each of the wheels, the lateral boom deck extension hydraulic cylinder 238 (which positions the lateral boom base mounting assembly 236), and the adjustable extension shield 406 and deflector shield 408 of the rotary cutting head assembly 400. Finally, FIG. 23 illustrates laser controls associated with the laser assembly 500.

Figure 24A:
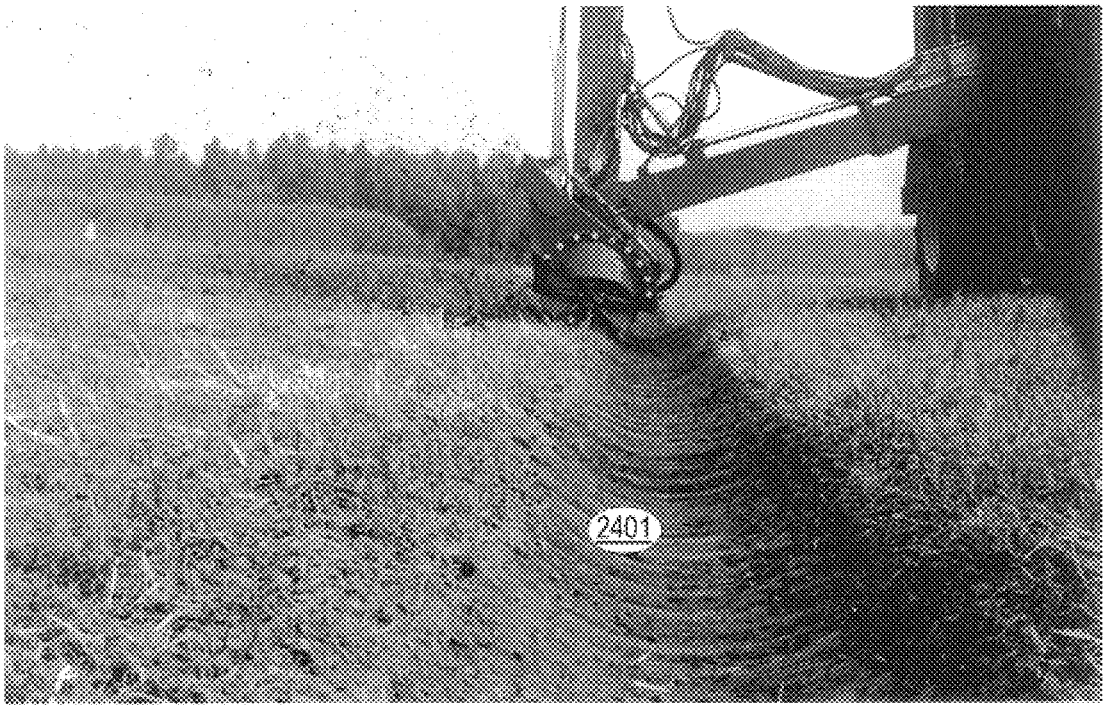
FIG. 24 is a view of the device cutting a ditch.
Figure 24B:
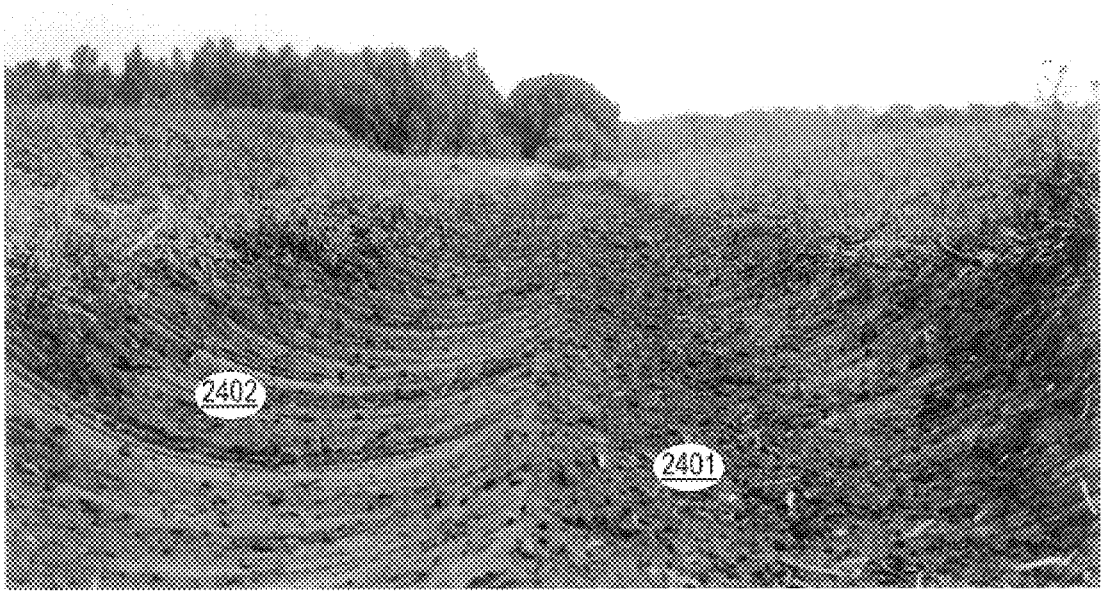
Figure 25:
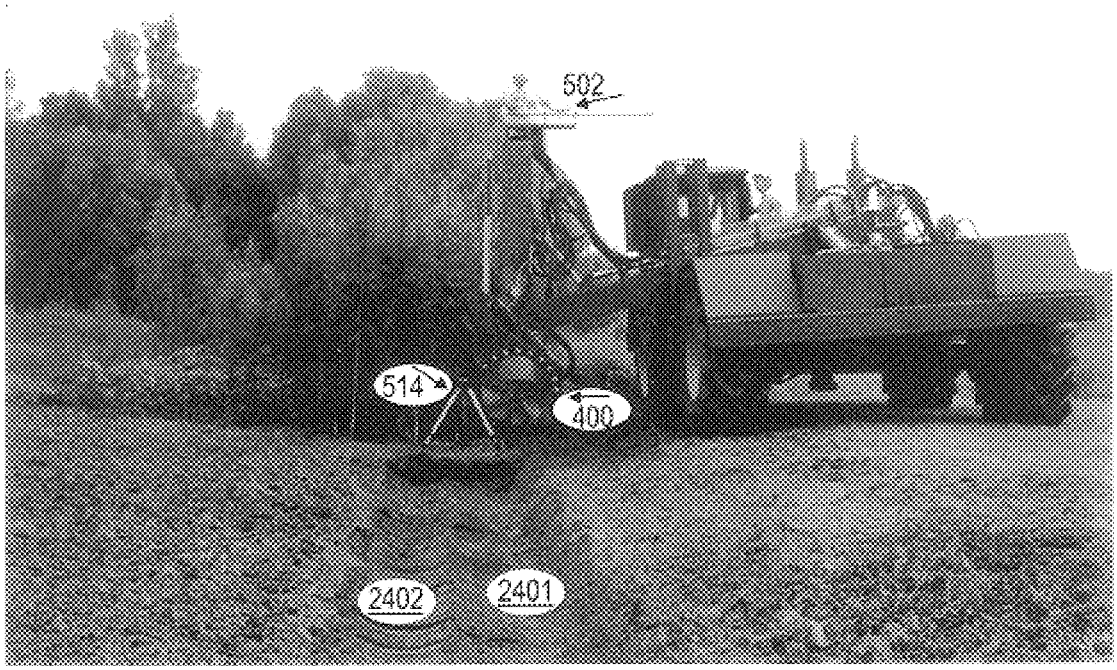
FIG. 25 is a front view showing an adjustment of the laser receiver.
Figure 26:
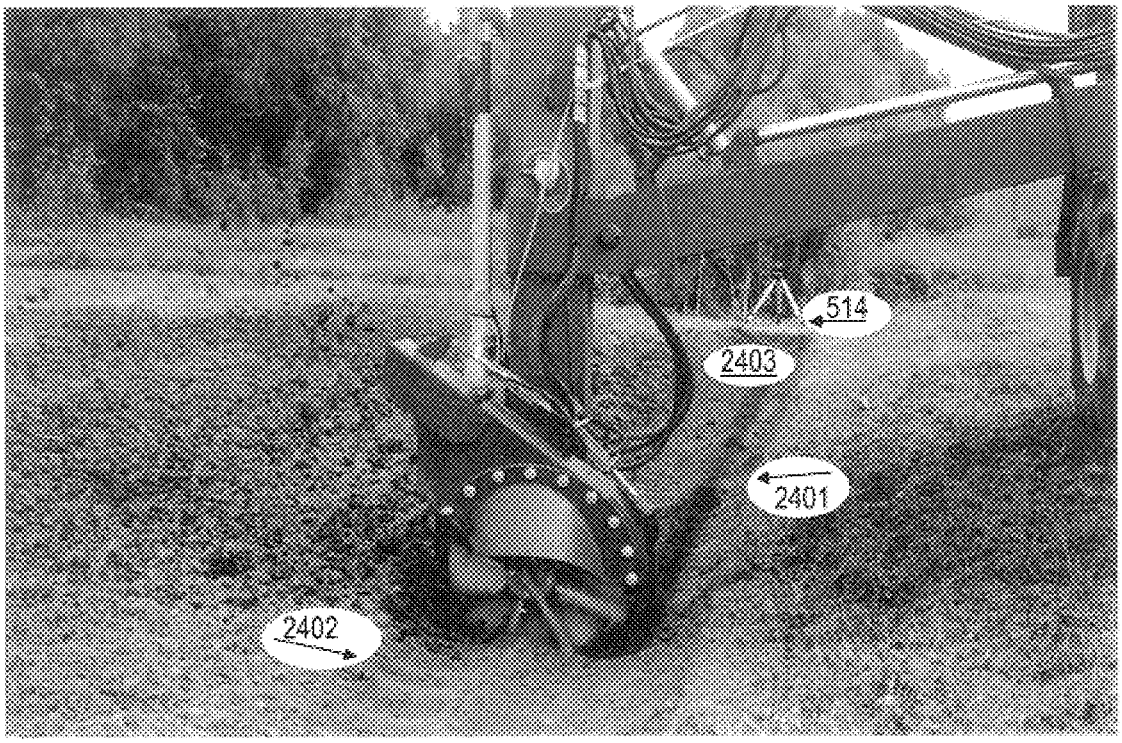
FIG. 26 is a view of the self-propelled rotary excavator cutting a ditch with the device which emanates the laser beam on a tripod in the background.

The excavation of a ditch 2400 will now be explained with reference to FIG. 24. As explained in further detail below, the boom assemblies 200, 300 and rotary cutting head assembly 400 are positioned at the desired ditch location, and a first portion 2401 of a ditch is created by a single pass of the excavator 10. The rotary cutting head assembly 400 is then slightly offset from its initial position and a second pass is performed as shown in FIG. 24. The second pass results in the creation of a second ditch portion 2402 as shown in FIGS. 24 and 25. Next the rotary cutting head assembly 400 is positioned to cut a third ditch portion 2403 at a position centered between and deeper than the first ditch portion 2401 and second ditch portion 2402 as shown in FIG. 26. All three positions 2401–2403 were cut with vertical and lateral laser control.

In preferred embodiments, each of the wheel hydraulic pumps 68, 70, 72 and 74 are a 23 series Sundstrand hydraulic pump. Preferably, the valve bank 66 is a V-42 Gresen sectional valve bank. The drive box 80 is preferably a Funk series 56013. The cutting head hydraulic pump 78 is preferably a 25 series Sundstrand hydraulic pump which is preferably driven at approximately 2,200 r.p.m. with a displacement of 10.12 cubic inches. Likewise, the hydraulic motor at each wheel is a 23 series Sundstrand hydraulic motor. The pumps are driven at approximately 2,200 r.p.m. and the wheel drive gear box ratio is 115:1. The displacement of the 23 series Sundstrand hydraulic pump/motor is 5.43 cubic inches. The rotary cutting head hydraulic drive motor 426 is a 24 series Sundstrand hydraulic motor with a displacement of 7.24 cubic inches. All pumps and motors have a 5,000 psi relief valve. The diesel engine 90 is preferably a 318 Detroit diesel engine producing approximately 300 horsepower.

In operation, the self-propelled rotary excavator 10 moves in parallel to the side of the ditch being maintained or excavated, as shown in FIGS. 10, 24, 25, and 26. The cutting of such a ditch is accomplished by the proper control of the lateral telescopic extendable boom assembly 200 connected to a vertical telescopic extendable boom assembly 300 with a rotary cutting head assembly 400 attached to the lower end of the vertical telescopic boom assembly 300. The lateral and vertical telescopic extendable boom assemblies 200, 300 enable the rotary cutting head assembly 400 to be positioned outward from the excavator 10 and downward toward the ground for the purpose of excavating a new ditch or cleaning out silt and debris from an existing ditch, as shown in FIGS. 1, 10, 24, 25, and 26.

The function of the lateral telescopic boom assembly 200 is to extend the rotary cutting head assembly 400 outward to the selected cutting position. The lateral telescopic extendable boom 202 is the moveable section of the lateral telescopic boom assembly 200 which fits inside the lateral telescopic stationary boom 204. The lateral telescopic stationary boom 204 encloses and serves as a guide for the lateral telescopic extendable boom 202, as shown in FIGS. 1, 2, 3 and 6.

The lateral telescopic stationary boom 204 is mounted on a lateral boom base mounting assembly 236, as shown in FIGS. 7 and 11. The lateral telescopic stationary boom 204 is connected to the lateral boom base mounting assembly 236 through a large pivot pin 248 located at the rear of the lateral telescopic stationary boom 204.

As shown in FIGS. 7 and 11 the lateral boom base mounting assembly 236 is moveable across the top of the self-propelled rotary excavator 10 by a lateral boom deck extension hydraulic cylinder 238. The lateral boom base mounting assembly 236 is held in position by the lateral boom deck extension guide 244 as shown in FIG. 11.

A lateral telescopic extendable boom hydraulic cylinder 206 extends and retracts the lateral telescopic extendable boom 202 relative to the lateral telescopic stationary boom 204. Slidably mounted within the lateral telescopic extendable boom hydraulic cylinder 206 is a lateral telescopic extendable boom hydraulic cylinder ram 210. The lateral telescopic extendable boom hydraulic cylinder ram 210 is connected to the lateral telescopic extendable boom 202 through a lateral telescopic extendable boom hydraulic cylinder ram pin 208. The lateral telescopic extendable boom hydraulic cylinder ram pin 208 is secured in a lateral telescopic extendable boom hydraulic cylinder ram pin mounting bracket 212. The lateral telescopic extendable boom hydraulic cylinder ram pin mounting bracket 212 is connected to the lateral telescopic extendable boom 202. The lateral telescopic extendable boom hydraulic cylinder 206 moves the lateral telescopic extendable boom 202 and rotary cutting head assembly 400 to the selected position for excavation. During excavation, the position of the lateral telescopic extendable boom hydraulic cylinder 206 and the lateral telescopic extendable boom hydraulic cylinder ram 210 may be controlled by the laser alignment control receiver 502 mounted horizontally on top of the vertical boom assembly 300, as shown in FIGS. 1 and 3. Also included is a lateral boom rest 50, as shown in FIG. 1.

As shown in FIGS. 2 and 6, the lateral telescopic stationary boom roller 232 is positioned at the bottom of the outward end of the lateral telescopic stationary boom 204. The lateral telescopic extendable boom 202 extends and retracts with its weight supported by the lateral telescopic stationary boom roller 232, reducing friction and allowing more freedom of movement. The lateral telescopic stationary boom roller 232 is externally exposed and can be serviced through receptacles on either side of the lateral telescopic boom assembly 200.

The lateral telescopic boom assembly 200 also has a lateral telescopic extendable boom internal roller 234 located at the rear and upper part of the lateral telescopic extendable boom 202, as shown in FIG. 6. The lateral telescopic extendable boom internal roller 234 contacts the inside of the upper portion of the lateral telescopic stationary boom 204. The lateral telescopic extendable boom 202 extends and retracts with its weight reacted by the lateral telescopic extendable boom internal roller 234. Servicing and inspection ports are located on each side of the lateral telescopic stationary boom 204. The lateral telescopic extendable boom internal roller 234 can be inspected and serviced by moving the lateral telescopic extendable boom 202 to the position where the internal roller is exposed through the inspection ports located on each side of the lateral telescopic stationary boom 204.

The lateral boom deck extension guide 244 partially encloses and is a guide for the lateral boom deck extension sliding base plate 246 attached to the bottom of the lateral boom base mounting assembly 236, as shown in FIG. 11.

As shown in FIG. 11, the lateral boom deck extension hydraulic cylinder mounting bracket 240 is mounted on the ram end of the lateral boom deck extension hydraulic cylinder 238. The lateral boom deck extension hydraulic cylinder mounting bracket 240 is connected to the base of the lateral boom deck extension sliding base plate 246.

As shown in FIGS. 2 and 7, twin lateral boom hydraulic cylinders 216, 218 are each connected at one end to the lateral boom base mounting assembly 236 and at the other end to the lateral telescopic stationary boom 204 so as to lift the lateral telescopic stationary boom 204 while the lateral telescopic stationary boom 204 is being moved inward or outward from the self-propelled rotary excavator 10 by the lateral boom deck extension hydraulic cylinder 238. Each of the twin lateral boom hydraulic cylinders 216 and 218 are connected to the lateral telescopic stationary boom 204 through a lateral boom hydraulic cylinder ram pin 220, as shown in FIGS. 2 and 7. The purpose of lifting the lateral telescopic stationary boom 204 is to reduce or remove the weight from the lateral boom rest 50, as shown in FIGS. 1 and 2, when extending or retracting the lateral telescopic stationary boom 204 with the lateral boom base mounting assembly 236.

The lateral telescopic boom assembly 200 is guided vertically by a boom guide 40, as shown in FIGS. 1, 2, and 3. The boom guide 40 serves as a vertical guide and brace for the lateral telescopic boom assembly 200. The boom guide 40 supports the lateral telescopic boom assembly 200 in the event there are excessive forward or backward forces due to encountering obstacles during the cutting of a ditch. The boom guide 40 also serves as a guide to the lateral boom rest 50, which elevates and lowers the lateral telescopic stationary boom 204. The lateral boom rest 50 supports the weight of the lateral telescopic boom assembly 200 while the self-propelled rotary excavator 10 is in the process of excavating, as shown in FIGS. 1 and 2. The boom guide 40 includes a right front lateral boom vertical guide 42, a left front lateral boom vertical guide 44, a right rear lateral boom vertical guide 46, a left rear lateral boom vertical guide 48, all of which are connected to the frame assembly 100. A lateral boom rest assembly vertical guide 52 is slidably mounted in between the right front, left front, right rear, and left rear lateral boom vertical guides 42, 44, 46 and 48, as shown in FIG. 2.

As shown in FIGS. 1 and 2, a four-stage lateral boom hydraulic cylinder 222 is pivotally connected to the frame 100 at one end and is attached to the lateral boom rest assembly 50 at its other end. The four stage lateral boom hydraulic cylinder 222 is attached to the frame assembly 100 by a four stage lateral boom hydraulic cylinder base pin 224. A four stage lateral boom hydraulic cylinder shield housing 226 surrounds the four stage lateral boom hydraulic cylinder 222. The purpose of the four stage lateral boom hydraulic cylinder 222 is to raise, lower and support the lateral telescopic stationary boom 204 while the machine is excavating. The four stage lateral boom hydraulic cylinder 222 controls the elevation of the lateral boom rest 50 which controls the position and supports the lateral telescopic stationary boom 204 during the excavation process. The lateral boom rest 50 is located on top of the four stage lateral boom hydraulic cylinder 222. The lateral boom rest 50 allows the lateral telescopic stationary boom 204 to rest while the self-propelled rotary excavator 10 is in the process of excavating ditches. During this time, the twin lateral boom hydraulic cylinders 216 and 218 are disengaged and are not functioning. This allows the four stage lateral boom hydraulic cylinder 222 with the lateral boom rest 50 to control the elevation of the lateral telescopic stationary boom 204. This provides resting support for the lateral telescopic stationary boom 204 near the area of excavation as compared to the twin lateral boom hydraulic cylinders 216, 218. This allows more precise control when elevating and lowering the lateral telescopic stationary boom 204. With the twin lateral boom hydraulic cylinders 216 and 218 disengaged, the only downward pressure exerted on the rotary cutting head rotor 414 while excavating is the weight of the lateral telescopic boom assembly 200, the vertical boom assembly 300 and the rotary cutting head assembly 400. This allows upward movement of the lateral and vertical boom assemblies 300 and 400 and the rotary cutting head rotor 414 in the event an obstruction is encountered while excavating.

As shown in FIGS. 2, 3 8, and 28*a, b, c*, a lateral telescopic extendable boom hydraulic hose grouping assembly support 214 connects to both the lateral telescopic extendable boom 202 and the lateral telescopic stationary boom 204. The lateral telescopic extendable boom hydraulic hose grouping assembly support 214 is connected to the lateral telescopic extendable boom 202 via a hose grouping assembly frontal pin and mounting bracket 228, as shown in FIG. 2. A hose grouping assembly rear pin and mounting bracket 230 connects the lateral telescopic extendable boom hydraulic hose grouping assembly support 214 to the lateral telescopic stationary boom 204. The lateral telescopic extendable boom hydraulic hose grouping assembly support 214 raises and lowers the hydraulic hoses when the lateral telescopic extendable boom 202 is retracted and extended, respectively. The lateral telescopic extendable boom hydraulic hose grouping assembly support 214 moves downward with the extension of the lateral telescopic extendable boom 202. As the lateral telescopic extendable boom 202 is retracted, the lateral telescopic extendable boom hydraulic hose grouping assembly support 214 raises the hoses away from moving parts. This prevents the hoses from being entangled and damaged. As the lateral telescopic extendable boom 202 moves outward the lateral telescopic extendable boom hydraulic hose grouping assembly support 214 is lowered and allows the hoses to extend with the lateral telescopic extendable boom 202. As the lateral telescopic extendable boom 202 moves inward, the hoses are again lifted out of the way of the moving machinery. The position of the lateral telescopic extendable boom hydraulic hose grouping assembly support 214 is also used as a steering indicator guide by the operator when the self-propelled rotary excavator 10 is operating and excavating. The position of the lateral telescopic extendable boom hydraulic hose grouping assembly support 214 is used as a visual guide for steering the self-propelled rotary excavator 10.

The cab 20 is conveniently located on the frame assembly 100 to enable the operator to comfortably watch the area of excavation, as shown in FIGS. 1, 3, and 19. The cab is attached to the frame assembly 100 at the frontal cab supporting base 24. From such a location the operator can view other working components. The position of the cab 20 also helps to provide for the safety and comfort of the operator. The frame of the cab 20 is constructed from steel tubing and sheet metal, so as to provide ample protection for the operator. The windows are constructed of heavy safety glass panels.

The front and right side windows of the cab 20 have heavy screens 22 to give protection from flying debris or other excavated materials. The screens are mounted in frames that are attached to the cab 20 by hinges and pins. The pins may be pulled and the screens may be opened for window cleaning.

The upper hinged rear window 30, as shown in FIG. 10, is hinged to the cab 20 so that it may be opened for added operator comfort. The upper hinged rear window 30 can be held in a selected position by air support cylinders. The upper hinged rear window 30 can also be used as a secondary exit over the right rear fender 108.

The cab 20 has a conventional steel side door 32 with a glass panel and a securing latch, as shown in FIG. 10.

Inside the cab 20 is located the operational controls of the self-propelled rotary excavator 10 along with laser controls, as shown in FIGS. 19, 21, 22 and 23. The operational controls include a safety "kill" switch for immediate engine 90 shut down, should the need arise. This switch is conveniently located on the floor of the cab near the door.

The exhaust pipes of the diesel engine 90 are surrounded by expanded steel muffler safety shields 92, as shown in FIG. 1. A safety handrail 26 attached to the frame assembly 100 is shown in FIG. 2. The safety handrail 26 is mounted on the front of the cab 20 above the grated steps 25. The handrail gives hand support to the top of the grated deck floor. The grated steps 25 are conveniently located in front of the cab 20.

The hydraulic fluid reservoir 60 is mounted on the front vehicle frame beam 104. The hydraulic fluid reservoir 60 can retain up to 350 gallons of hydraulic fluid. The interior of the hydraulic fluid reservoir 60 contains circulation baffles.

A hydraulic fluid cooler 62 is mounted adjacent to the diesel engine 90 and on the front vehicle frame beam 104.

The priority flow regulator valves 64, as shown in FIG. 10, convert an open center hydraulic system through a closed center hydraulic system. The valves are driven by proportional time output of the control box. The priority flow regulator valves 64 are necessary to produce a smooth laser response when the lasers are in operation.

The hydraulic mechanisms are remotely controlled with a joy stick in the cab 20. The valves are electromechanical proportional hydraulic pilot type valves. A bank of V-42 Gresen valves (valve bank 66) is shown in FIGS. 15 and 20.

The laser alignment control receiver 502 or the laser receiver 508 can be independently disengaged to allow the performance of the separate functions as determined by the operator, as shown in FIG. 1.

The laser alignment control receiver 502 of the laser equipment 500 can be disengaged so as to allow the operator to make curves in the ditch and still maintain the same ditch bottom elevation. The laser receiver 508 can be turned off to allow the operator to excavate deeper cuts to establish silt traps at water furrow junctions and near the area of pipe drops.

The operator may disengage the vertical telescopic boom pendulous sensing device 306 which controls the vertical position of the vertical boom assembly 300 via the vertical telescopic boom positioning control cylinder 312. The vertical telescopic boom position control cylinder 312 is rotatably connected at one end to the lateral telescopic extendable boom 202 and its other end it is connected to a vertical telescopic boom position control cylinder adjustable pivot pin mounting bracket 314. The vertical telescopic boom position control cylinder adjustable pivot pin mounting bracket 314 is in turn connected to the vertical telescopic stationary boom 304.

Such a device allows the operator to use the vertical telescopic boom position control cylinder 312 to make sweeping cuts for wider ditch excavations near a pipe drop or outflow pipe.

The vertical telescopic boom pendulous sensing device 306 is mounted on the front of the vertical telescopic stationary boom 304. The vertical telescopic boom pendulous sensing device 306 detects the side tilt of the vertical telescopic stationary boom 304. Any deviation from zero tilt sends a signal from the vertical telescopic boom pendulous sensing device 306 to a control unit in the cab 20 that will in turn send a signal to the control valve to correct the vertical telescopic boom position control cylinder 312 so as to attain the correct vertical telescopic stationary boom 304 position.

Quick release hydraulic hose coupler connectors 316 are shown in FIG. 2. The quick release hydraulic hose coupler connectors 316 are used to disconnect the hydraulic hoses when preparing the self-propelled rotary excavator 10 for transport and when replacing the outer hydraulic hoses when needed.

A vertical boom lifting bracket 318 is connected to the vertical telescopic stationary boom 304, as shown in FIG. 2. The vertical boom lifting bracket 318 is used for attaching lifting cables when the vertical boom assembly 300, the rotary cutting head assembly 400 and the lateral telescopic extendable boom 202 are being removed from the machine for transport.

The laser alignment control receiver 502 is mounted horizontally on top and over the vertical boom assembly 300, as shown in FIGS. 1, 3, 8 10 and 25. The laser alignment control receiver 502 detects the plane of light established by the laser transmitter 514, as shown in FIGS. 24, 25 and 26. A signal is sent from the laser alignment control receiver 502 to the control box mounted in the cab 20, as shown in FIG. 23, the signal being indicative of the relative position of the laser signal to the plane of light. The control box sends a signal to the horizontal boom cylinder's control valve commanding hydraulic movement of the lateral telescopic extendable boom hydraulic cylinder's ram 210 to keep the laser alignment control receiver 502 centered in the plane of light in the correct horizontal position.

A vertical sensing depth control laser receiver 508 and laser receiver mount 510 are mounted vertically on the base of the vertical telescopic extendable boom 302. The laser receiver 508 detects the plane of light established by the laser transmitter 514. A signal produced by the laser receiver 508 is sent to the laser control box mounted in the cab 20, as shown in FIG. 23, which is indicative of the relative position of the laser receiver 508 relative to the plane of light. The laser control box sends a signal to the vertical boom cylinder's control valve commanding hydraulic movement of the vertical telescopic boom hydraulic cylinder 320 and ram 322 to keep the laser receiver 508 centered in the plane of light and on a grade.

The rotary cutting head assembly 400 includes a rotary cutting head shield 402 which partially encloses the rotary cutting head rotor 414. The rotary cutting head shield 402 contains the spoil material as it is cut and removed from the soil surface and set in motion. The rotary cutting head shield 402 then directs the excavated material to a controlled point of departure through the shield outlet. The rotary cutting head shield 402 also protects the self-propelled rotary excavator 10 from excavated material by directing the flow of this material through the rotary cutting head shield outlet 409 away from the self-propelled rotary excavator 10.

The rotary cutting head shield 402 has mounted to it, as a forward extension, a rotary cutting head frontal extension shield 404. The rotary cutting head frontal extension shield 404 prevents excavated material from moving forward and directs it back toward the area of the rotary cutting head rotor 414 where it will be set in motion and expelled through the outlet of the rotary cutting head shield 402. The rotary cutting head frontal extension shield 404 bolts onto the rotary cutting head shield 402 and also serves as a structural brace for the rotary cutting head shield 402, as shown in FIG. 3.

The rotary cutting head assembly 400 further includes a rotary cutting head adjustable extension shield 406 which is mounted on the rotary cutting head shield 402. The rotary cutting head adjustable extension shield 406 is extended when making excavations less than one-half the diameter of the rotary cutting head. The rotary cutting head adjustable extension shield cylinder 412 extends the rotary cutting head adjustable extension shield 406 downward as material is excavated from shallow cuts. The rotary cutting head adjustable extension shield 406 prevents excavated material from moving toward the self-propelled rotary excavator 10 and laser equipment 500 when making a shallow cut and directs the excavated material through the cutting head shield outlet away from the machine. The rotary cutting head adjustable extension shield 406 is utilized when the rotor is excavating shallow depths clockwise or counter-clockwise as shown in FIGS. 3, 29*a* and 29*b*.

The rotary cutting head adjustable extension shield 406 is actuated by a rotary cutting head adjustable extension shield cylinder 412. One end of the rotary cutting head adjustable extension shield cylinder 412 is connected to the rotary cutting head adjustable extension shield 406 and the other end is connected to a mounting bracket on the rotary cutting head shield 402, as shown in FIGS. 3, 29*a* and 29*b*.

The rotary cutting head assembly 400 is also equipped with a rotary cutting head adjustable deflector shield 408, as shown in FIG. 4. The rotary cutting head adjustable deflector shield 408 is actuated by a rotary cutting head adjustable deflector shield hydraulic cylinder 410 so as to adjust the deflection of the spoil material and which controls the elevation of the spoil material as it exits the outlet of the rotary cutting head shield 402. The rotary cutting head adjustable deflector shield 408 also helps to direct the outflowing spoil into the field away from the self-propelled rotary excavator 10 and away from the laser receivers 502 and 508 located above the rotary cutting head rotor 414. The rotary cutting head adjustable deflector shield hydraulic cylinder 410 is connected at one end to the rotary cutting head adjustable deflector shield 408 and the other end is connected to a mounting bracket attached to the rotary cutting head shield 402.

Rotary cutting head blade mounting brackets 420 are located on the rotary cutting head rotor 414. Rotary cutting head rotor impeller blades 416 fit across the end of the rotary cutting head blade mounting brackets 420. The rotary cutting head rotor impeller blades 416 have the same forward curved cutting edge as the rotary cutting head rotor blades 418. The rotary cutting head rotor impeller blades 416 also have a hard surface on the forward edge of the cutting side. The rotary cutting head rotor impeller blades 416 are used with a four rotor cutting blade configuration. The rotary cutting head rotor impeller blades 416 are mounted on alternate rotary cutting head blade mounting brackets 420.

Rotary cutting head rotor blades 418 are rectangular, heavy, steel blades with a forward curved sharpened cutting edge having a hard surface on the forward cutting side, as shown in FIGS. 4, 31 and 32. The rotary cutting head rotor blades 418 are mounted lengthwise and bolted to the rotary cutting head blade mounting brackets 420, as shown in FIGS. 4, 31 and 32.

A rotary cutting head central reversible blade 422 is mounted on the front and center of the rotary cutting head rotor 414, as shown in FIGS. 4, 31 and 32. The rotary cutting head central reversible blade 422 is sharpened with the cutting edge rotating toward the surface to be cut. The rotary cutting head central reversible blade 422 is a reversible blade. When reversing the direction of rotation, the rotary cutting head central reversible blade 422 can be removed, the ends reversed, and reinstalled and bolted back in place. By reversing the ends, it will change the direction of the cut.

A rotary cutting head hydraulic drive motor 426 is used to convert the hydraulic power into mechanical rotary power, as shown in FIGS. 8 and 9. The rotary cutting head hydraulic drive motor 426 is attached to a hydraulic motor drive gear box 450, as shown in FIG. 18. The rotary cutting head hydraulic drive motor gear box 450 is 6-K Heco gear box. The rotary cutting head hydraulic drive motor 426 has a 5,000 pound per square inch relief valve.

The rotary cutting head mounting plate 428 is used to connect the rotary cutting head hydraulic drive motor 426 to the rotary cutting head shield housing 430. The rotary cutting head mounting plate 428 is circular and is connected to the bottom of the vertical telescopic extendable boom 302 by the rotary cutting head boom mounting bracket 444 and the rotary cutting head mounting pin 442, as shown in FIGS. 9 and 18.

A rotary cutting head position adjustment turnbuckle 432 is provided so as to position the rotary cutting head assembly 400 about the rotary cutting head mounting pin 442. The rotary cutting head position adjustment turnbuckle 432 is connected to the rotary cutting head mounting plate 428 by way of the turnbuckle base pin mounting bracket 436 and the turnbuckle base pin 434. The upper end of the rotary cutting head position adjustment turnbuckle 432 is connected to the turnbuckle outer pin mounting bracket 440 and the turnbuckle outer pin 438, as shown in FIG. 9. Turning the rotary cutting head position adjustment turnbuckle 432 in an extension rotation will move the rotary cutting head assembly 400 forward. Rotating the rotary cutting head position adjustment turnbuckle 432 so as to retract its length will cause the rotary cutting head assembly 400 to move towards the rear of the self-propelled rotary excavator 10. Any retracting or extending movement will be pivoted on the rotary cutting head mounting pin 442.

The rotary cutting head assembly 400 is provided with rotary cutting head hydraulic hose quick coupler connectors 446, as shown in FIG. 8. The primary purpose of these rotary cutting head hydraulic hose quick coupler connectors 446 are to disconnect the hoses when the self-propelled rotary excavator 10 is to be transported to another location. By disconnecting the hoses, the rotary cutting head assembly 400, vertical boom assembly 300 and the lateral telescopic extendable boom 202 can be removed from the self-propelled rotary excavator 10 so as to reduce the transporting width of the self-propelled rotary excavator 10. The rotary cutting head hydraulic hose quick coupler connectors 446 may be useful in the event there is any need for replacement of hoses in the area of the rotary cutting head rotor 414.

In operation, the rotary cutting head assembly 400 is placed and held at the proper depth and aligned in position by a vertical telescopic extendable boom 302 extending downward from the end of the lateral telescopic extendable boom 202 that extends laterally from the side of the self-propelled rotary excavator 10.

The lateral telescopic extendable boom 202 is moved lateral out from the self-propelled rotary excavator 10 by the lateral telescopic extendable boom hydraulic cylinder 206, as shown in FIG. 1. The lateral telescopic extendable boom 202 can be further extended by another hydraulic cylinder that can move the lateral telescopic boom assembly 200 on a track across the upper central machine frame, as discussed earlier and shown in FIG. 11.

Attached to the lateral telescopic extendable boom 202 is the vertical telescopic stationary boom 304. The vertical telescopic extendable boom 302 is moved vertically by the vertical telescopic boom hydraulic cylinder 320, as shown in FIG. 8. The ram end of the vertical telescopic boom hydraulic cylinder 320 is attached to the vertical telescopic extendable boom 302 which is the moveable section of the vertical boom assembly 300 and the base end of the vertical telescopic boom hydraulic cylinder 320 being attached to the vertical telescopic stationary boom or stationary section 304.

Attached to the lower end of the vertical telescopic extendable boom 302 is a rotary cutting device known as the rotary cutting head assembly 400.

The cutting depth and position of the rotary cutting head assembly 400 is determined by the vertical and lateral position of the vertical telescopic extendable boom 302. Another hydraulic cylinder called the vertical telescopic boom position control cylinder 312 is attached, at an angle, to the vertical telescopic stationary boom 304 and the lateral telescopic extendable boom 202, as shown in FIG. 3. The vertical telescopic boom position control cylinder 312 moves the rotary cutting head rotor 414 laterally in a sweeping movement independent of the lateral telescopic extendable boom 202.

The combination and configuration of the lateral and vertical telescopic boom assemblies 200 and 300 give the operator the ability to use lasers for precise ditch alignment and depth control when excavating. The operator has the option to excavate new or maintain existing ditches to a selected grade regardless of the unevenness of the terrain.

The laser receiver 508 and the laser receiver mount 510 are mounted vertically on the base of the vertical telescopic extendable boom 302. The laser receiver 508 detects the plane of light established by the laser transmitter 514, as shown in FIGS. 3 and 26. The laser receiver 508 sends a signal to the laser control box mounted in the cab 20 as to the relative position of the laser receiver 508 to the plane of light, as shown in FIG. 23. The control box sends a signal to the control valve of the vertical telescopic boom hydraulic cylinder 320 commanding hydraulic movement of the vertical telescopic boom hydraulic cylinder ram 322 so as to keep the laser receiver 508 centered in the plane of light and on grade.

The laser alignment control receiver 502 is mounted on the laser alignment control receiver position adjustment tube 506 on top of and over the vertical telescopic extendable boom 302, as shown in FIG. 1. The laser alignment control receiver 502 detects the plane of light established by the laser transmitter 514, shown in FIG. 25. The laser alignment control receiver 502 sends a signal to the control box mounted in the cab 20, as to the relative position of the laser alignment control receiver 502 to the plane of light, as shown in FIG. 23. The control box sends a signal to the control valve of the lateral telescopic extendable boom hydraulic cylinder 206 commanding hydraulic movement of the lateral telescopic extendable boom hydraulic cylinder ram 210 so as to keep the laser alignment control receiver 502 centered in the plane of light in the correct horizontal position.

The position of the laser alignment control receiver 502 can be adjusted horizontally on the laser alignment control receiver position adjustment tube 506 when making multiple parallel cuts while excavating or maintaining large drainage ditches. Adjusting the position of the laser alignment control receiver 502 on the self-propelled rotary excavator 10 saves time since the laser transmitter 514 may remain in a fixed location, otherwise, the position of the laser alignment control receiver 502 would remain constant and the location of the laser transmitter 514 would be changed. A horizontally mounted electric telescopic mast can replace the laser alignment control receiver position adjustment tube 506 in the event numerous multiple parallel cuts would justify the added expense. Such a modification would allow the operator to quickly make horizontal adjustments of the laser alignment control receiver 502 from the cab 20 of the self-propelled rotary excavator 10.

A vertical telescopic boom pendulous sensing device 306 is mounted on the front of the vertical telescopic stationary boom 304, as shown in FIG. 3. The vertical telescopic boom pendulous sensing device 306 detects the side tilt of the vertical boom assembly 300.

When the vertical boom assembly 300 is not in a vertical position the vertical telescopic boom pendulous sensing device 306 sends a signal to a control unit in the cab 20 that will in turn send a signal to a control valve to adjust the vertical telescopic boom position control cylinder 312 so as to attain a vertical boom position as shown in FIGS. 1 and 3.

The laser alignment control receiver 502 or the laser receiver 508 can be independently disengaged so as to allow the operator to determine separately the functions of the vertical boom assembly 300 and the lateral telescopic boom assembly 200.

As an example, the laser alignment control receiver 502 can be disengaged, thus allowing the operator to manually steer the self-propelled rotary excavator 10 to place a curve in the ditch while maintaining precise laser control of the bottom elevation of the ditch. Likewise, the laser receiver 508 can be disengaged so as to allow the operator to excavate deeper cuts so as to establish silt traps at water furrow junctions or in the vicinity of pipe drops.

The operator may utilize the vertical telescopic boom position control cylinder 312 to make sweeping cuts for wider ditch excavations. In such cases, it is necessary to disengage the vertical telescopic boom pendulous sensing device 306 as it controls the position of the vertical telescopic boom position control cylinder 312.

The rotary cutting head assembly 400 is mounted to the lower end of the vertical telescopic extendable boom 302, as shown in FIGS. 1, 3, 4, 5, 8 and 9. A rotary cutting head boom mounting bracket 444 attached to the lower end of the vertical telescopic extendable boom 302 is connected by the large rotary cutting head mounting pin 442 to a heavy, vertically mounted, circular steel plate, known as the rotary cutting head mounting plate 428, on which the rotary cutting head assembly 400 is mounted, as shown in FIG. 9. The pin, called the rotary cutting head mounting pin 442, is a hinge or pivot pin which allows adjustment of the position of the rotary cutting head rotor 414 turning the rotary cutting head position adjustment turnbuckle 432, as shown in FIGS. 8 and 9.

The rotary cutting head hydraulic drive motor gear box 450 is attached to the rotary cutting head mounting plate 428. The rotary cutting head hydraulic drive motor 426 is attached to the rear of the rotary cutting head hydraulic drive motor gear box 450.

A splined drive shaft from the rotary cutting head hydraulic drive motor gear box 450 extends forward through an opening in the rotary cutting head mounting plate 428. A splined hub, called the rotary cutting head rotor hub 448, is attached to the splined drive shaft, as shown in FIG. 17. The rotary cutting head rotor 414 is attached to the rotary cutting head rotor hub 448.

The rotary cutting head rotor 414 is a large heavy circular plate with eight rotary cutting head blade mounting brackets 420 attached to the forward side, as shown in FIGS. 3 and 4. The rotary cutting head blade mounting brackets 420 have holes so as to mount the rotary cutting head rotor blades 418 on the front side of the rotary cutting head rotor 414 or to mount rotary cutting head rotor impeller blades 416 on the end of the rotary cutting head blade mounting brackets 420. The rotary cutting head rotor impeller blades 416 and the rotary cutting head rotor blades 418 may be mounted on either side of the rotary cutting head blade mounting brackets 420 for clockwise or counterclockwise excavation, as shown in FIGS. 3, 4, 5, 8, 9, 31 and 32.

When excavating with the rotary cutting head rotor 414 moving in a counterclockwise direction, the rotary cutting head counter rotation deflector shield 424 should be installed, as shown in FIGS. 8 and 9. The rotary cutting head counter rotation deflector shield 424 is bolted to the inside of the rotary cutting head shield 402 so as to prevent the spoil material from recycling around the rotary cutting head rotor 414 and as such prevents the spoil material from accumulating in the rotary cutting head shield 402 by deflecting the spoil material away from the rotary cutting head rotor 414.

The rotary cutting head rotor 414 has eight rotary cutting head blade mounting brackets 420 attached to the forward side of the rotary cutting head rotor 414 which provide a choice of several blade configurations. Depending on the direction of rotation of the rotary cutting head rotor 414, the rotary cutting head rotor blades 418 and the rotary cutting head rotor impeller blades 416 can be mounted on either side of the rotary cutting head blade mounting brackets 420.

The cutting component of the rotary cutting head assembly 400 is the rotary cutting head rotor 414. Because of variable soil and moisture conditions, it is desirable to have a choice of several blade configurations. Depending on the soil and moisture conditions, the type of blades and the number of blades to be mounted on the rotary cutting head rotor 414 can be selected for use in making the most efficient cut. The more efficient configurations are to use four or eight rotary cutting head rotor blades 418. When using four rotary cutting head rotor blades 418, the rotary cutting head rotor impeller blades 416 can be used on the alternate rotary cutting head blade mounting brackets 420. Such a configuration can be used on the rotary cutting head rotor 414 as operating in either a clockwise or counterclockwise direction.

The rotary cutting head rotor 414 is driven with sufficient power and with a continuous and adequate speed so as to excavate new field drainage ditches and lateral drainage ditches when using either blade configuration. Both types of ditches can be excavated to a sufficient size with the proper bottom grade so as to quickly remove excess amounts of water from the field to be drained.

The self-propelled rotary excavator 10 has the ability to maneuver over undulating fields and uneven ground. The self-propelled rotary excavator 10 has the ability to work along the side of a bank or the side slope of a road. When the self-propelled rotary excavator 10 works along a slope, it continues to maintain a vertical boom position which give the machine the ability to excavate a straight and uniformly graded ditch.

The self-propelled rotary excavator 10 has a wide, sturdy frame, as shown in FIGS. 1 and 25. The component parts of the self-propelled rotary excavator 10 are arranged and placed in areas on the frame assembly 100 so as to help counterbalance the weight of the boom assemblies 200 and 300 when they are extended, as shown in FIGS. 1, 10 and 25.

The self-propelled rotary excavator 10 is a four wheel drive vehicle, since each wheel is associated with its own hydraulic pump and hydraulic motor system. The self-propelled rotary excavator 10 has large rubber tires having adequate flotation for use in moderately wet field conditions. The self-propelled rotary excavator 10 is hydraulically driven to propel itself at a given speed independent of other machine functions.

The rear axle of the self-propelled rotary excavator 10 is connected directly to its frame. Such a connection adds stability to the self-propelled rotary excavator 10 when extending and withdrawing the lateral and vertical telescopic boom assemblies 200 and 300 during operation. The front axle 136 is connected to the front axle frame section 138 of the self-propelled rotary excavator 10 by the front axle hinge pin 146 that allows the front wheels 112 and 116 to move vertically when traveling over uneven terrain.

The directional control or steering of the self-propelled rotary excavator 10 is by a method called "skid steering". The rotation of the wheels on the left side of the self-propelled rotary excavator 10 are synchronized and the rotation of the wheels on the right side of the machine are also synchronized. The self-propelled rotary excavator 10 turns by commanding the wheels on one side of the self-propelled rotary excavator 10 to move at a different rate of speed than the wheels on the opposite side. Such a steering mechanism imparts the ability to make very minute correctional turns while the self-propelled rotary excavator 10 is in operation.

The self-propelled rotary excavator 10 is able to clean and maintain to grade existing field ditches while, simultaneously, spreading the spoil material evenly.

The self-propelled rotary excavator 10 can vary the rotary cutting head speed and the ground speed independently of the other machine functions. Such a separation of the functions of the components gives the operator the necessary options for selecting the proper combination of parameters so as to perform the most efficient work.

Spoil material ejected from the self-propelled rotary excavator 10 is broken into small particles and distributed evenly as a thin layer that does not block natural drainage or existing field water furrows. Furthermore, silt deposited into the ditch by field erosion is thinly spread back over the field to the area from which most of it originated by operation of the self-propelled rotary excavator 10. Such small particles of spoil dry quickly when exposed to air and sunlight. After the spoil material dries, rain will soften and further pulverize this material into smaller particles which will easily blend back into the top soil.

The evenly distributed spoil material allows for normal farming operations, such as field preparation or crop cultivation, which can follow the ditching operation without any special tillage treatment to the area in which the spoil material was deposited.

The most efficient and productive time over the year to use any excavating equipment is when the soil is dry. Historically, soil is usually the driest during the late spring, summer and early fall months. However, such times of the year are during the planting, growing and harvesting seasons.

This is not always a limitation to the self-propelled rotary excavator 10 since crop damage from ditch maintenance by the self-propelled rotary excavator 10 in most young growing crops is usually much less than the yield losses sustained following ditch maintenance by a hydraulic trackhoe and dozer done under wet soil conditions prior to planting the crop. Furthermore, hydraulic trackhoes and dozers are not able to utilize the spring, summer and early fall months since they severely damage or destroy a growing crop in the area of their work.

The self-propelled rotary excavator 10 is able to perform the ditch maintenance during the growing season while imparting very little damage to the growing crop. Such a reduction in the damage to the growing crop can be accomplished by reducing the size of the spoil particles and lowering their impact velocity.

The spoil particle size can be regulated by selecting a suitable forward speed of the self-propelled rotary excavator 10, using the appropriate motor speed and using a selected number of cutting blades to match the condition of the soil.

Counter rotating the rotary cutting head rotor 414 results in the spoil particles being lofted or elevated which reduces their lateral velocity.

Obviously, numerous modifications and variations of the present invention are possible in light of the above teachings. It is therefore to be understood that within the scope of the appended claims, the invention may be practiced otherwise than as specifically described herein.

What is claimed is:

1. An excavator comprising:

a frame;

a lateral telescopic boom assembly connected to the frame, said lateral telescopic boom assembly having a lateral telescopic stationary boom and a lateral telescopic extendable boom, said lateral telescopic extendable boom slidably connected to said lateral telescopic stationary boom;

a vertical boom assembly having a vertical telescopic stationary boom and a vertical telescopic extendable boom, said vertical telescopic stationary boom pivotally connected to said lateral telescopic extendable boom, said vertical telescopic extendable boom slidably connected to said vertical telescopic stationary boom;

a rotary cutting head assembly pivotally attached to an end of said vertical telescopic extendable boom, said rotary cutting head assembly having a rotary cutting head rotor;

a lateral telescopic extendable boom hydraulic cylinder pivotally connected to the frame at one end and at the other end contacting said lateral telescopic stationary boom;

a lateral telescopic extendable boom hydraulic cylinder connected at one end to said lateral telescopic stationary boom and at the other end to said lateral telescopic extendable boom; and a vertical telescopic boom hydraulic cylinder attached at one end to said vertical telescopic stationary boom and at another end to said vertical telescopic extendable boom.

2. An excavator as recited in claim 1, wherein said rotary cutting head rotor includes at least one of a rotary cutting head rotor blade and a rotary cutting head rotor impeller blade.

3. An excavator as recited in claim 1, further comprising a lateral boom base mounting assembly mounted between said lateral telescopic stationary boom and the frame, wherein said lateral boom base mounting assembly is connected to said lateral telescopic stationary boom, and wherein said lateral boom base mounting assembly is slidably mounted on the frame.

4. An excavator as recited in claim 3, further comprising at least one lateral boom hydraulic cylinder connected at one end to said lateral boom base mounting assembly and connected to said lateral telescopic stationary boom at the other end.

5. An excavator as recited in claim 1, further comprising a vertical telescopic boom position control cylinder pivotally connected to said lateral telescopic extendable boom at one end and pivotally connected to said vertical telescopic stationary boom at another end.

6. An excavator as recited in claim 5, further comprising a vertical telescopic boom pendulous sensing device attached to said vertical telescopic stationary boom, said vertical telescopic boom pendulous sensing device outputs a signal to a controller which controls said vertical telescopic boom position control cylinder so as to maintain said vertical boom assembly in a vertical position.

7. An excavator as recited in claim 1, further comprising a laser alignment control receiver attached to said vertical boom assembly, said laser alignment control receiver receiving a light signal from a laser transmitter, said laser alignment control receiver outputting a first signal to a controller which compares said first signal to a predetermined value and creates a second signal based on a difference between said first signal and said predetermined value, said second signal being output from said controller to control a control valve of said lateral telescopic extendable boom hydraulic cylinder so as to control the horizontal position of said rotary cutting head assembly.

8. An excavator as recited in claim 1, further comprising a depth control laser receiver mounted on said vertical boom assembly, said depth control laser receiver receiving a light signal from a laser transmitter, said depth control laser receiver outputting a third signal to a controller which compares said third signal to a predetermined value and creates a fourth signal based on a difference between said third signal and said predetermined value, said fourth signal being output from said controller to control a control valve of said vertical telescopic boom hydraulic cylinder so as to control the vertical position of said rotary cutting head assembly.

9. An excavator as recited in claim 1, wherein said excavator includes a hydraulic power source, each of said rotary cutting head assembly, said lateral boom hydraulic cylinder, said lateral telescopic extendable boom hydraulic cylinder and said vertical telescopic boom hydraulic cylinder being operatively connected to said hydraulic power source, respectively.

10. An excavator as recited in claim 4, wherein said excavator includes a hydraulic power source, each of said rotary cutting head assembly, said lateral boom hydraulic cylinder, said lateral telescopic extendable boom hydraulic cylinder, said vertical telescopic boom hydraulic cylinder and said at least one lateral boom hydraulic cylinder being operatively connected to said hydraulic power source, respectively.

11. An excavator as recited in claim 5, wherein said excavator includes a hydraulic power source, each of said rotary cutting head assembly, said lateral boom hydraulic cylinder, said lateral telescopic extendable boom hydraulic cylinder, said vertical telescopic boom hydraulic cylinder, said at least one lateral boom hydraulic cylinder and said vertical telescopic boom position control cylinder being operatively connected to said hydraulic power source, respectively.

12. An excavator as recited in claim 1, further comprising:

an axle pivotally mounted to the frame such that the axle will pivot to compensate for uneven ground.

13. The excavator as recited in claim 12, further comprising:

a first wheel;

a second wheel;

a first hydraulic motor connected to the first wheel and a first end of the axle; and a second hydraulic motor connected to the second wheel and a second end of the axle.

14. A self-propelled rotary excavator comprising:

a prime mover including a frame;

a plurality of wheels attached to said frame;

a lateral telescopic boom assembly connected to said frame, said lateral telescopic boom assembly having a lateral telescopic stationary boom and a lateral telescopic extendable boom, said lateral telescopic extendable boom slidably connected to said lateral telescopic stationary boom;

a vertical boom assembly having a vertical telescopic stationary boom and a vertical telescopic extendable boom, said vertical telescopic stationary boom pivotally connected to said lateral telescopic extendable boom, said vertical telescopic extendable boom slidably connected to said vertical telescopic stationary boom;

a rotary cutting head assembly pivotally attached to an end of said vertical telescopic extendable boom, said rotary cutting head assembly having a rotary cutting head rotor;

a lateral boom hydraulic cylinder pivotally connected to said lateral boom base mounting assembly at one end and at the other end connected to said lateral telescopic stationary boom;

a lateral telescopic extendable boom hydraulic cylinder pivotally connected at one end to said lateral telescopic stationary boom and at the other end to said lateral telescopic extendable boom; and a vertical telescopic boom hydraulic cylinder attached at one end to said vertical telescopic stationary boom and at another end to said vertical telescopic extendable boom.

15. A self-propelled rotary excavator as recited in claim 14, further comprising a hydraulic power source mounted on said frame, wherein each of said rotary cutting head assembly, said lateral boom hydraulic cylinder, said lateral telescopic extendable boom hydraulic cylinder and said vertical telescopic boom hydraulic cylinder being operatively connected to said hydraulic power source, respectively.

16. A self-propelled rotary excavator as recited in claim 15, wherein each of said plurality of wheels being operatively connected to said hydraulic power source.

17. A self-propelled rotary excavator as recited in claim 16, further comprising a deflector shield movably attached to the rotary cutting head assembly such that the deflector shield may be positioned to control a trajectory and break up clumps of spoil exiting the rotary cutting head assembly.

* * * * *